United States Patent [19]

Wright et al.

[11] 3,933,570

[45] Jan. 20, 1976

[54] PANEL MANUFACTURING MACHINE AND METHOD

[75] Inventors: Lawrence W. Wright, Scottsdale; Leon H. Tolleson; Daniel P. Abrahamson, both of Phoenix; Paul M. Thomas, Paradise Valley; Eugene E. Crile, Phoenix, all of Ariz.

[73] Assignee: The Thomas 1970 Trust, Phoenix, Ariz.

[22] Filed: Oct. 3, 1973

[21] Appl. No.: 403,056

Related U.S. Application Data

[60] Continuation of Ser. No. 132,788, April 9, 1971, abandoned, which is a division of Ser. No. 138,949, April 30, 1971, Pat. No. 3,789,101.

[52] U.S. Cl. ..... 156/558; 52/749; 141/258; 156/182; 425/455

[51] Int. Cl.[2] ..... E04G 21/14

[58] Field of Search ..... 52/747, 749; 156/71, 182, 156/297, 557–559; 425/455

[56] References Cited

UNITED STATES PATENTS

| | | | |
|---|---|---|---|
| 3,350,833 | 11/1967 | Larger | 52/749 |
| 3,382,640 | 5/1968 | Thomas et al. | 52/749 |
| 3,585,092 | 6/1971 | Storer | 52/749 |
| 3,834,973 | 9/1974 | Kummerow | 52/749 X |

FOREIGN PATENTS OR APPLICATIONS

| | | | |
|---|---|---|---|
| 1,432,483 | 2/1966 | France | 52/749 |
| 1,127,812 | 9/1968 | United Kingdom | 52/749 |

*Primary Examiner*—Henry C. Sutherland
*Attorney, Agent, or Firm*—Fitch, Even, Tabin & Luedeka

[57] ABSTRACT

A panel manufacturing machine adapted to produce panels of building blocks; the machine involving the formation of a horizontal course of blocks in end-to-end relation to each other with mortared head joints between ends of the blocks and with bed mortar on top of the blocks, which course is transferred as a unit to be assembled with other courses of blocks to produce a panel. Further, the machine can progressively sense a modular measurement longitudinally of said course to control the overall length of each course when assembled and mortared together.

27 Claims, 50 Drawing Figures

FIG I 478
508
504
506
594
598
510
514
518
520
516
522
533
535
538
533a
533b
64
62
524
531
532
530
526
528
529
482
542
544
546
592
598
537
546'
592'
600
512
480
25

696
722
714
718
710
726
492
730
720
728
712
716
724
708
704
500
732
35
C
B
710
708
492
766
764
734
728
712
724
692
714
695
720
754
722
755
750
756
704
734
752
758
732
736
738
502
500
696
692
740
698
742
728
724
698
692
744
750
34
754
752
720
746
695
755
500
760
748
502
35
758
722
756
710
708
696
732
492
692

PANEL MANUFACTURING MACHINE AND METHOD

This application is a continuation of our prior application filed Apr. 9, 1971, Ser. No. 132,788, now abandoned, and is a division of our prior application filed Apr. 30, 1971, Ser. No. 138,949, issued as U.S. Pat. No. 3,789,101 on Jan. 29, 1974.

This invention relates to apparatus for manufacturing building block panels and more particularly to apparatus which is adapted to produce such panels in a rapid and accurate manner and which is capable of being operated automatically.

It has long been desired to lay masonry panels mechanically from generally rectangular building blocks, i. e. concrete blocks, cinder blocks bricks, and the like. The preassembled wall panels are subsequently assembled at the building site to form a completed wall or buiding section. The manufacture of such prefabricated panels is desirable for a number of reasons but in particular because of the reduction in labor cost, the rapidity of erection, and because such an operation eliminates to a great degree dependence on proper weather conditions.

Machines have been utilized to produce panels by mortaring together several superimposed courses of blocks. Such machines have been disposed over the wall panel being formed and have traveled longitudinally along the panel placing blocks sequentially on the upper surface of the panel and simultaneously making a head joint and bed joint for each block as it is laid. Such prior machines have been relatively complicated due to the fact that the mechanism used to place each block on a panel and to mortar in into place has been relatively complicated and expensive to maintain in operation. Further, there have been some problems with relation to the batching of mortar and transferring the mortar to the traveling mortar placement devices. The operations of these machines which set one block at a time on a panel being produced have been relatively slow in cycle rate and consequently have been limited in production volume. Additionally, such machines have employed massive traveling mechanisms which have of necessity been elevated progressively each time a course is placed upon a panel being produced so that the traveling mechanism may be in position to lay another course of blocks on top of the panel and accordingly, the production of a panel gives rise to problems attendant to the structure carrying the mechanism and for positioning it in various elevated positions. Further, the mortar placement mechanisms as well as the traveling mortar positioning mechanisms are relatively complicated and costly to operate and maintain.

Accordingly, it is the principal object of the present invention to provide a machine which may readily be adapted to form prefabricated panels from blocks and which makes possible high-speed, efficient operation.

Another object of the invention is to produce a machine which will produce prefabricated panels from blocks which panels have high strengths and which can be fabricated to close tolerances.

Other objects and advantages of the invention will be apparent from the following specification, appended claims and accompanying drawings in which:

The method employed herein, generally involves sequentially aligning unmortared blocks to form a course. Head joints are then made sequentially between the aligned blocks. Bed mortar is laid on the upper surface of the blocks. The mortared blocks are conveyed longitudinally in alignment without substantial disruptive forces on them and after a course is completed the blocks are rigidly clamped in alignment and incorporated, as a unit, with other similar modular courses to provide a panel. The mortar is permitted to set and thereafter the panel may be moved as a unit for incorporation in a building structure.

More specifically, the method involves maintaining the modular dimensions of the blocks by sensing the position of a fixed point on the block or on the course as the blocks are being formed into the course so that irregularities in dimensions of the blocks being assembled are compensated for in the head joints. The sensing means employed may also be operable to provide for the automatic accommodation of half-blocks as required so that the panel being formed can have a staggered configuration.

The step of sensing the position of the blocks so as to provide for modular lengths of blocks regardless of imperfections in the blocks makes possible the provision of panels whose lengths may be controlled to very close tolerances.

Another more specific aspect of the method involves sensing the position of a course in the panel in a vertical direction before the next completed course is applied to the panel. The course being transferred is thereby positioned to provide a modular height for that course which permits the maintenance of close tolerances in the vertical direction. This step permits any imperfections in the height of the blocks being used to be compensated for in the bed joints. Preferably, in practising the method, the course being applied to the panel is vibrated as a unit as it is being applied to the preceding courses, so that a good motar joint is obtained and this also aids in providing a rigid finished panel of accurate dimensions.

If desired, the method may also involve the step of striking the head joints so that the course of blocks as it is formed presents neat mortar joints without the necessity of hard work.

In the following paragraphs there are described several embodiments of machinery for carrying out the various method steps which have been outlined above. The carrying out of the method in the various manners disclosed results in a strong panel which is self-supporting and which may be handled with conventional lifting and hoisting equipment with a minimum of care as well as providing panels in which close tolerances, e.g. one-sixteenth of an inch or less, may be maintained in both the horizontal and vertical dimensions regardless of the length or height of the panels being produced.

Figure 1:
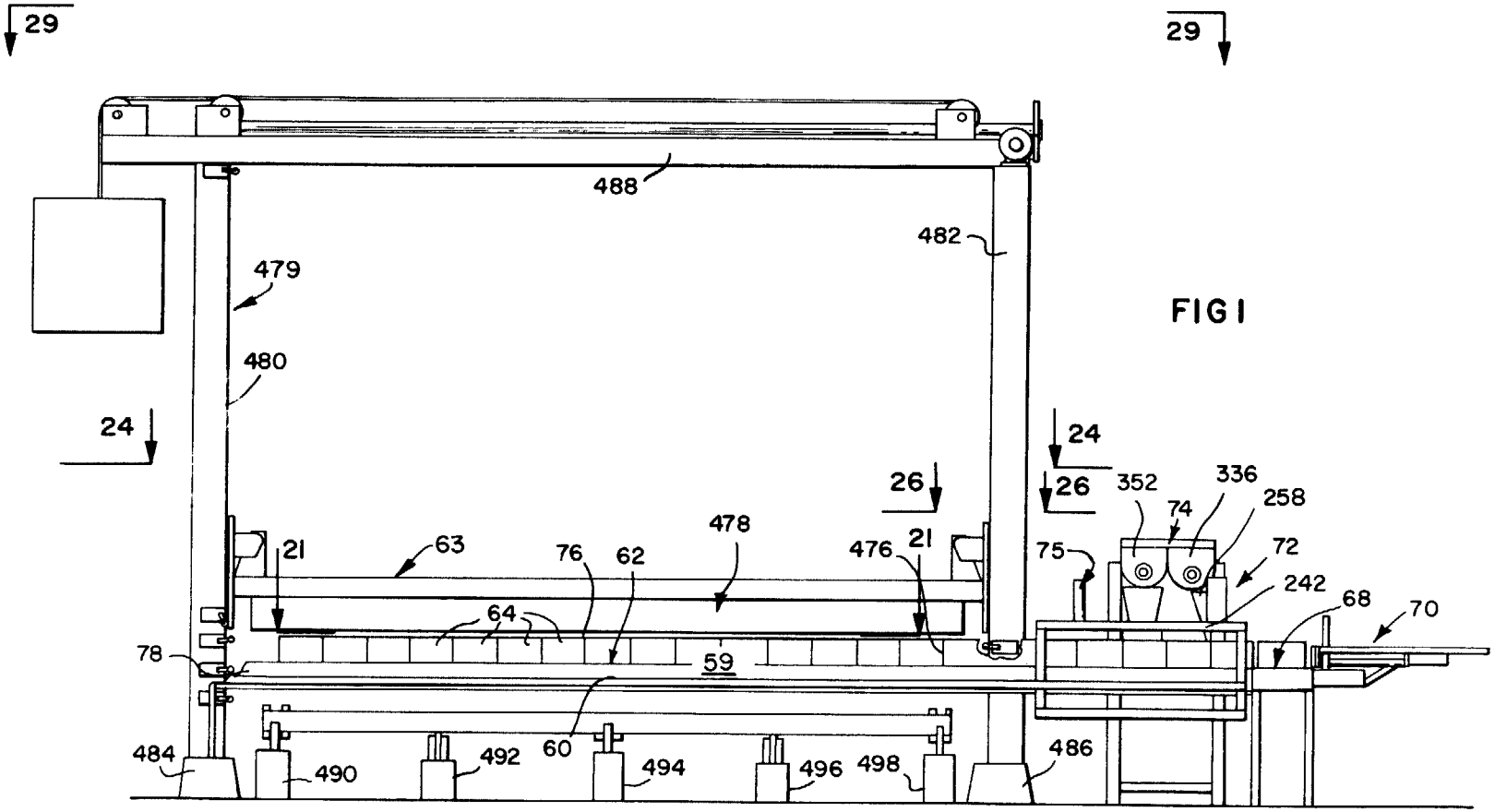
FIG. 1 is a side elevational view of a panel manufacturing machine embodying various of the features of the invention.
Figure 2:
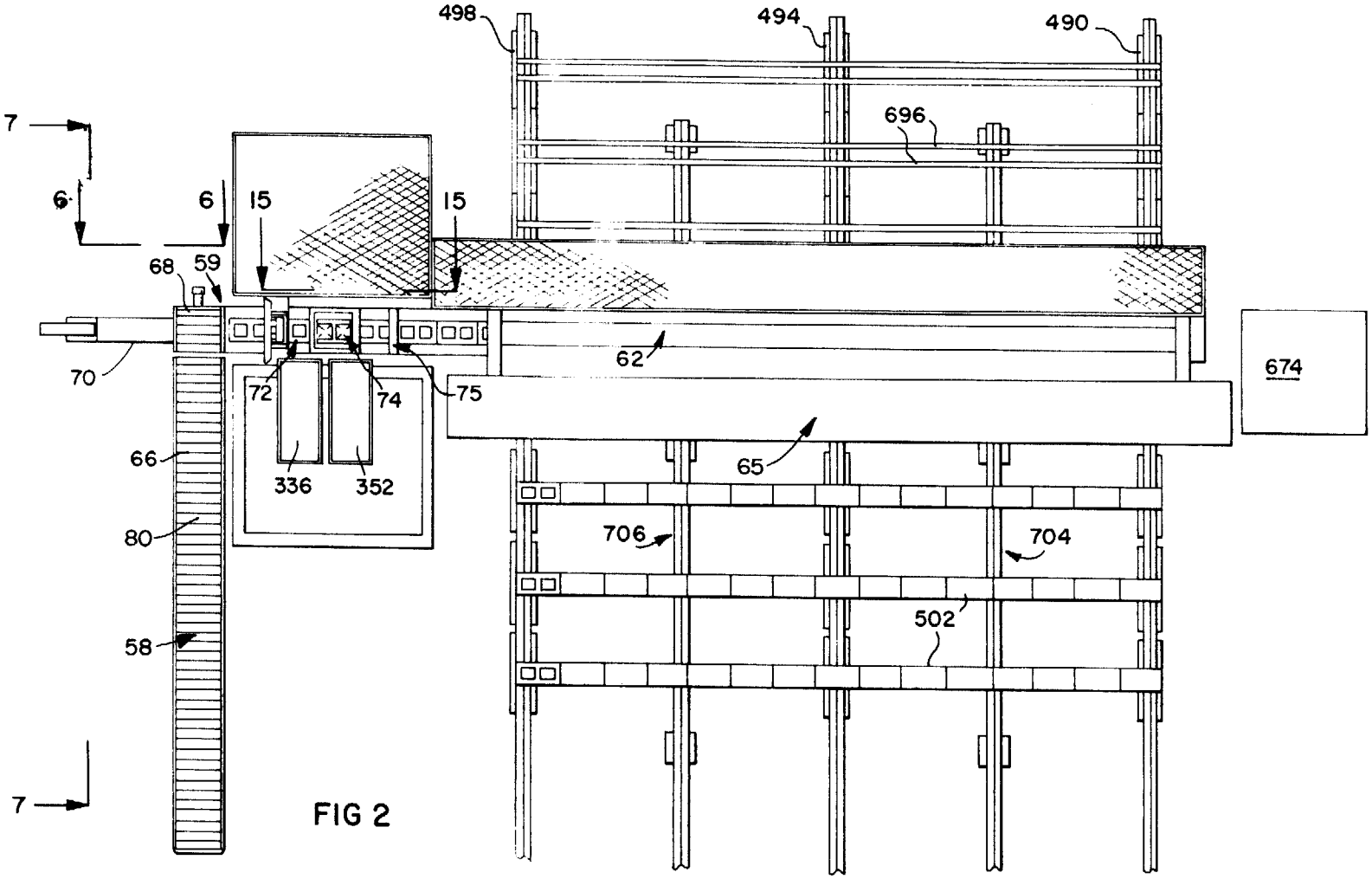
FIG. 2 is a plan view of the machine shown in FIG. 1.
Figure 3:
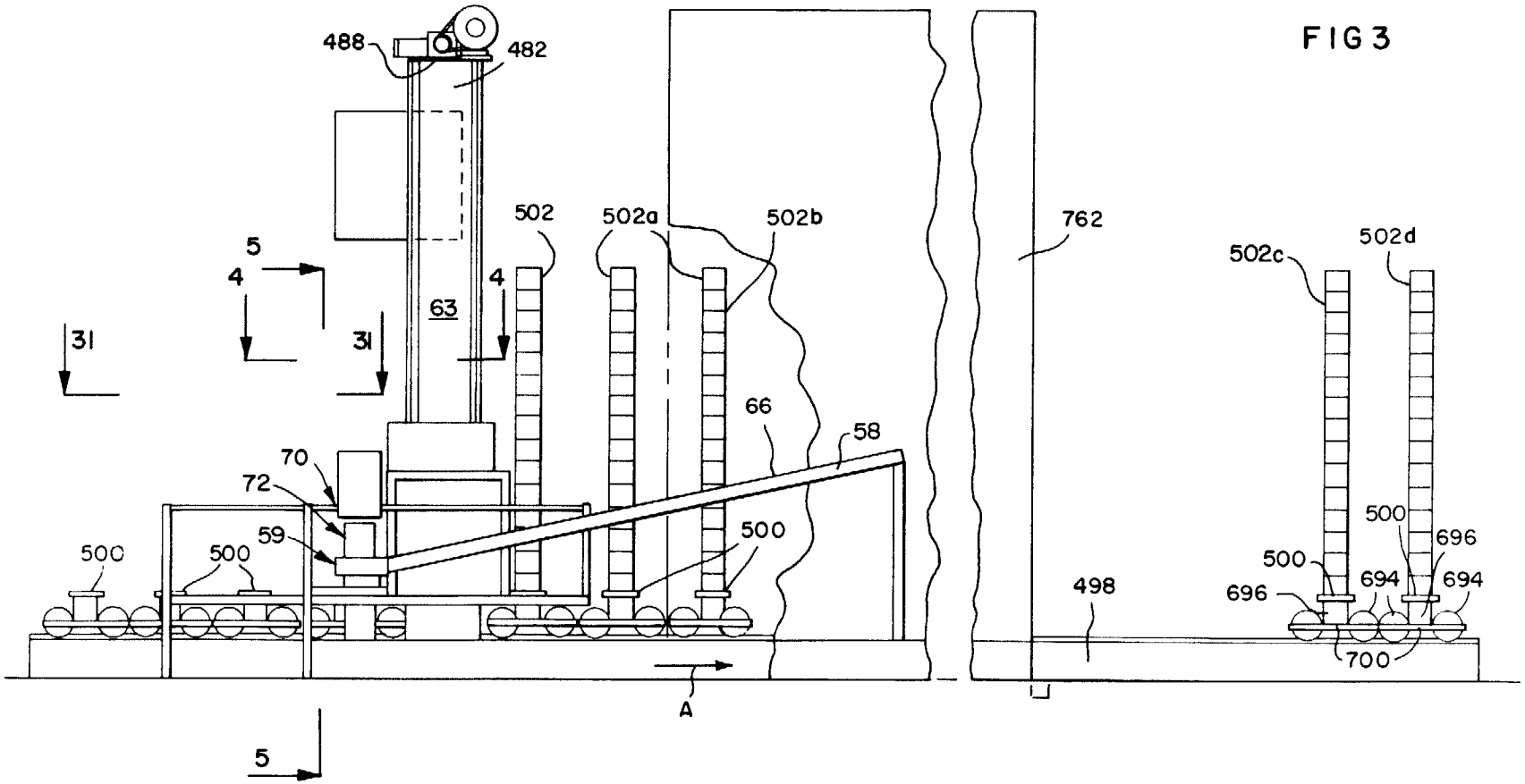
FIG. 3 is an end view of the machine shown in FIG. 1.

FIGS. 1, 2 and 3 are assembly views of a machine embodying various of the features of the invention. The machine illustrated is specifically adapted to process unmortared concrete blocks into a finished panel, but the features of the machine are equally applicable to the processing of other building block materials, e.g. cinder blocks, light weight aggregate blocks, bricks and the like into prefabricated panels.

In general, the illustrated machine includes an infeed station 58 which is adapted to feed unmortared blocks into the mechanism. A makeup station 59 is provided which includes a head joint forming station 72, a bed mortar station 74, a head joint striker station 75 and a conveyor and receiving mechanism 62 for the course of mortared blocks. A pusher mechanism 70 is provided which is adapted to align the blocks in end-to-end relationship and to transfer them from the infeed station 58 to the makeup station 59. A transfer station 63 is provided for moving a completed course of blocks as a unit from the makeup station 59 to a panel assembly station 65 where the completed course of blocks is assembled with courses which have been previously formed.

Figure 7:
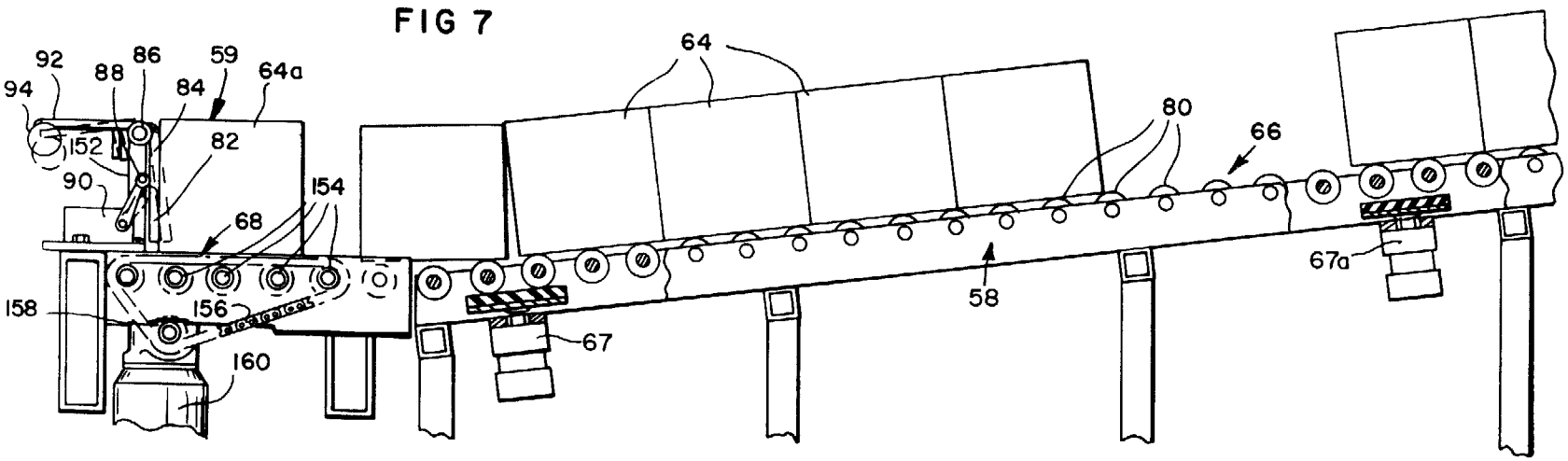
FIG. 7 is an enlarged, fragmentary, elevational view along line 7—7 of FIG. 2.
Figure 8:
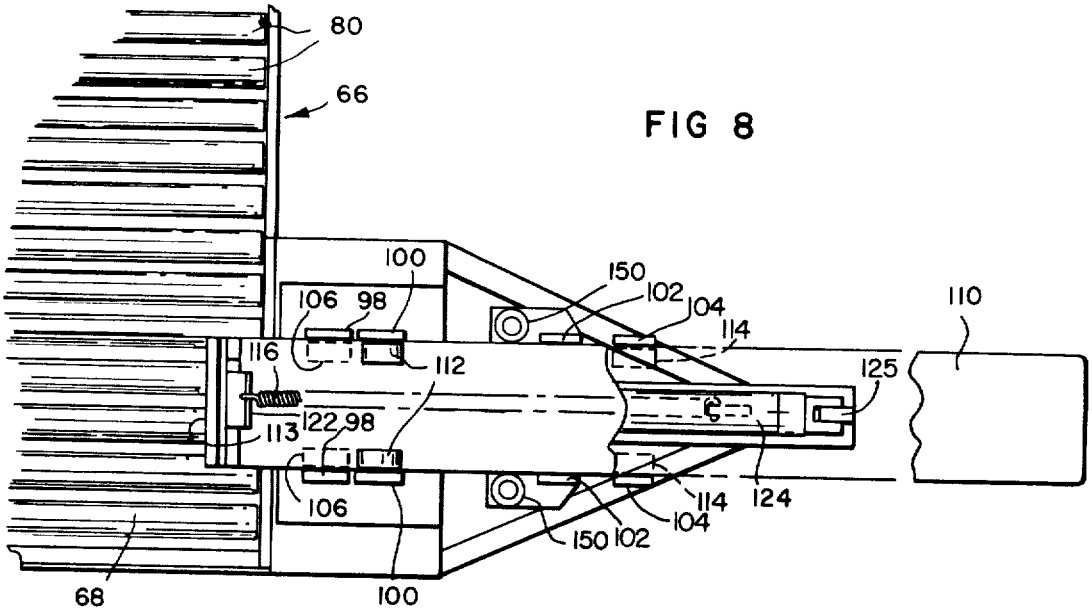
FIG. 8 is a fragmentary, plan view along line 8—8 of FIG. 6.

The infeed station 58 includes a conveyer 66 which is shown in detail in FIG. 7 of the drawings. The conveyer 66, illustrated, is disposed in a downwardly inclined position so that blocks placed on the conveyer 66 roll down by gravity to the makeup station 59. The conveyer 66 is provided with rollers 80 on which a series of blocks 64 are conveyed. In order to control the feeding rate of the blocks 64, hydraulically activated friction devices 67 and 67a are provided to gate the blocks onto and off of the conveyer as required. Cycling of the friction device 67 at the proper rate feeds one block at a time to the pusher mechanism 70 at the upstream end of the makeup station 59.

A block 64a, as it passes onto a receiving area 68 of the makeup station 59, engages the face 82 of plate member 84 which is pivoted about a bearing 86. The plate member 84, when pivoted, presses against a contact arm 88 of a switch 90 which is connected to actuate the pusher mechanism 70.

Coupled to the plate 82 is an arm 92 having a counterweight 94 which biases the plate 82 away from the arm 88 of actuates switch 90 when a block is not in position in the receiving area 68.

It is apparent that the switch 90 is actuated as each of the concrete blocks 64 is fed from the conveyer 66. The switch 90 acttuates electrical circuitry to initiate operation of the block pusher mechanism 70 shown in detail in FIG. 6 of the drawings.

Figure 4:
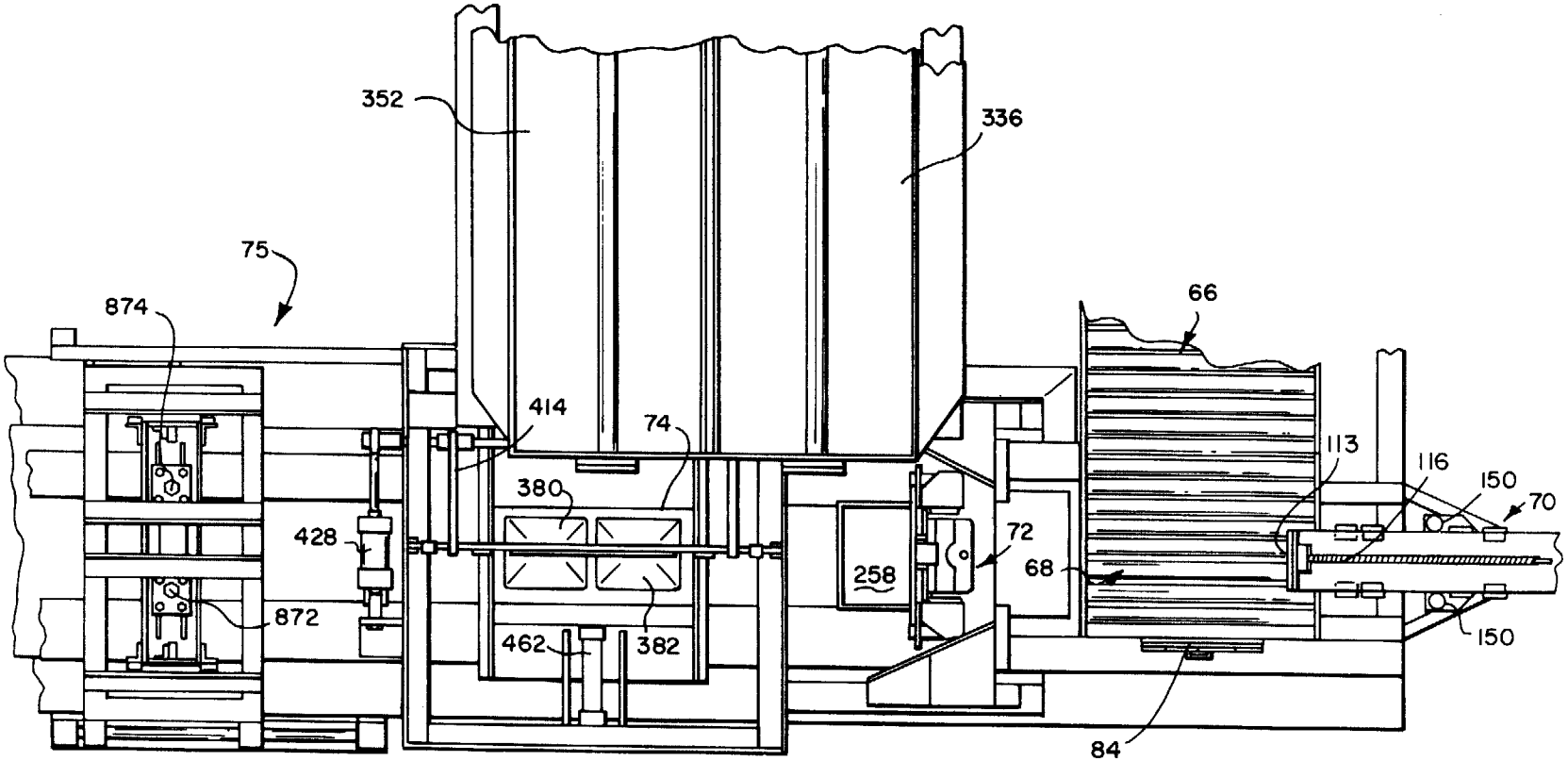
FIG. 4 is an enlarged fragmentary, plan view along line 4—4 in FIG. 3.
Figure 9:
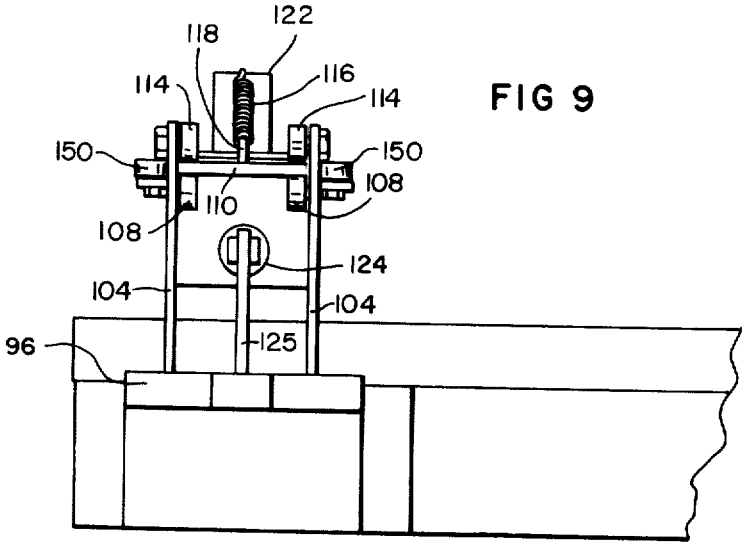
FIG. 9 is a fragmentary, end view along line 9—9 of FIG. 6.

The block pusher mechanism 70 is adapted to push the blocks 64 received from the conveyer 66 into end-to-end alignment with the blocks in the makeup station 59 preparatory to forming a mortared course of blocks. To this end the main frame 60 of the device includes a support 96 which is provided with upstanding brackets 98, 100, 102 and 104. The brackets 98 and 102 carry rollers 106 and 108 (FIGS. 6 and 9) which support a lower surface of a reciprocating plate 110. The upper side of the plate 110 is engaged by rollers 112 and 114 carried by the upstanding members 100 and 104 respectively. Thus, the plate 110 can reciprocate horizontally, guided by the two sets of rollers 106, 108 and 112, 114. In order to eliminate sidewise movement, plate 110 is also engaged by rollers 150 which are supported on posts 102 (FIGS. 4 and 6).

In order to engage a block 64, the end of the reciprocating plate 110 adjacent the end of the conveyer 66 is provided with a plate 113 which is mounted on an axially horizontal pivot 115 carried by plate 110. A tension spring 116 is connected between an upstanding tab 118 on the plate 110 and a lever portion 122 which extends upwardly from the plate 113.

In order to move the plate 110 with its associated pusher plate 113, a hydraulic cylinder 124 is provided. The hydraulic cylinder 124 is hingedly connected at one end to a bracket 125 on the support 96 and its plunger 126 is connected to a bracket 128 fixed to the plate 110. Consequently, plate 110 is reciprocated in accordance with actuation of the plunger 126 of the hydraulic cylinder 124 so as to move the plate 113 to the left in FIG. 6 to engage a vertical face on end 130 of a concrete block **64*a*. When the plate 113 engages the end of the concrete block 64a, the block 64a is moved into engagement with the next preceding block 64b having a rearward face 132. When the face 132 is engaged by the block 64*a*, the plate 113 is pivoted about the axis of the pivot 115 a sufficient distance to actuate a plunger 134 of an electrical switch 136 which de-energizes the cylinder 124 to stop movement of the block 64a. Thereafter, the plunger 126 is retracted and the spring 116 pivots the plate 113 away from the plunger 134 of the switch 136. In order that the block 64*a* is moved into engagement with the block 64*b* without excessive force, the tension of the spring 116 is adjusted to permit overcoming the frictional forces of the block 64a to limit the amount of pressure applied to the block 64a** to approximately that required to move it.

Figure 6:
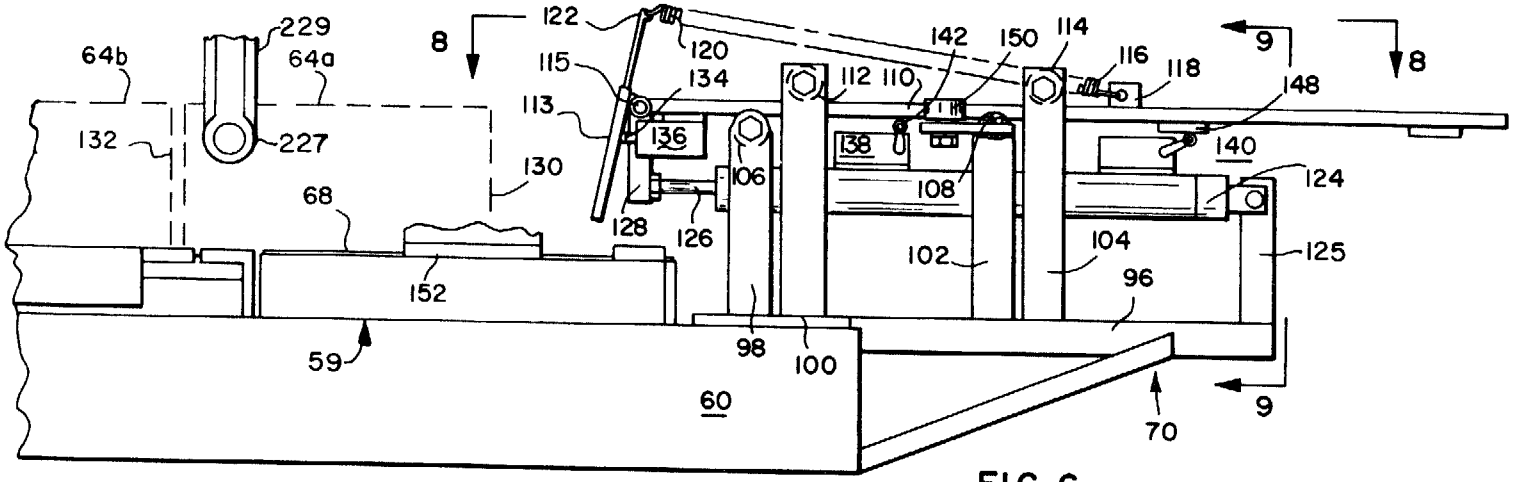
FIG. 6 is an enlarged, fragmentary, elevational view along line 6—6 of FIG. 2.

With reference to FIG. 6, it will be noted that the switch actuating plate member 84 shown in FIG. 7 is omitted from FIG. 6 and the mounting plate 152 which carries the bearing 86 is shown fragmentarily in FIG. 6. Likewise, the pusher mechanism 70 is omitted from the showing in FIG. 7.

In operation, the conveyer 66 delivers blocks 64 onto the receiving area 68. In this area the blocks 64 are supported on a plurality of drive rollers 154 which are driven by a chain 156 connected to a sprocket 158 of a motor 160. The motor 160 is controlled by the switch 90 and its operation is interrupted when a block **64*a* in the position shown in FIG. 7 actuates the switch 90** as hereinbefore described.

Figure 20:
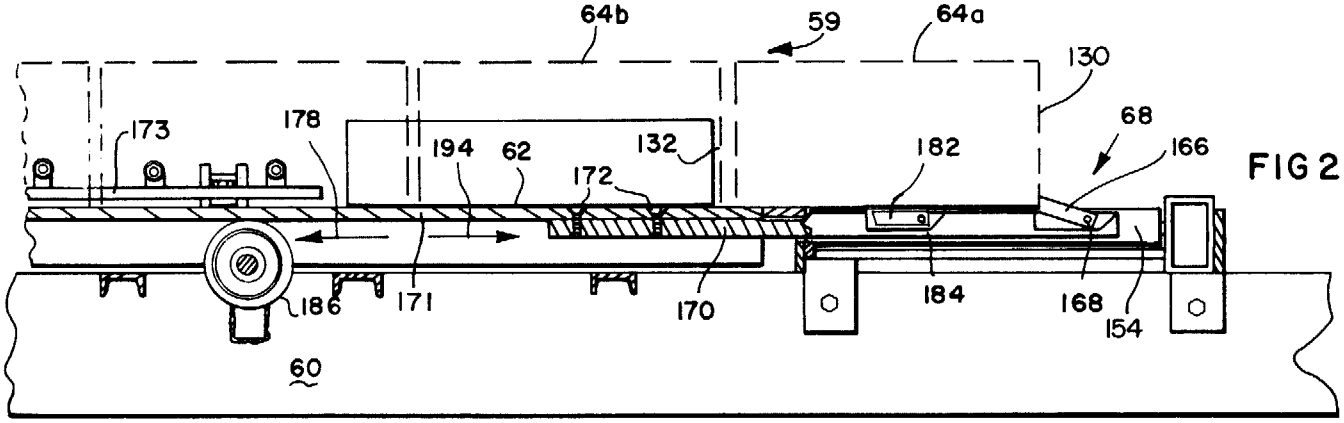
FIG. 20 is a fragmentary, elevational view along line 20—20 of FIG. 19, showing portions of the structure broken away and in section.

The pusher plate 113 then pushes the block **64*a* from the receiving area 68 into engagement with an end 132 of adjacent block as shown in FIGS. 6 and 20 of the drawings. When the pressure plate 113 has caused a solid abutment of one of the blocks 64a, pushed from the receiving area 68 toward the end 132 of the next adjacent block 64*b*, and when the abutment occurs between the blocks the switch 136 is operated and the pusher mechanism is retracted by the plunger 126**.

The rearward end 130 of the block **64*a* most recently pushed by the pusher plate 113 passes over a set of spring-loaded dogs 166 which are pivoted at 168 (FIG. 20) and which are arranged to reciprocate along the makeup station 59 by means of drawbars 170 as will be described. The block 64*a* as shown in FIG. 20 rests on the drive rollers 154 while the drawbars 170 are disposed between the rollers 154. The end of each dog 166 is spaced from the trailing face of the preceding block 64*b* a distance equal to the nominal legnth of a block plus the thickness of an average mortar head joint. Initially, upon being advanced by the push plate 113, the rearward end of the block 64*a* (FIG. 20) remains supported on the drive rollers 154. AS will hereinafter be described, all of the blocks 64 in the section of the course already formed are supported on a plate or table 171 which constitutes a part of the makeup station 59 in this embodiment. The table 171 conveys the blocks by a reciprocating action, the table advancing longitudinally whereupon the course is rigidly clamped by clamping means 173 and the table is then returned to its original position, the clamping means is then released and the action is cyclically repeated. The drawbars 170 are rigidly connected to the table 171 as by the bolts 172 shown in FIGS. 19 and 20. As a consequence, as the table 171 advances carrying block 64*b* forward, the frictional drag of the trailing edge of block 64*a* on the drive rollers 154 causes it to seat against dogs 166 which provides the proper space for the head joint. Further, with this construction any differences between the actual length of a block and the nominal length will be accommodated by a thicker or thinner head joint. A head joint and a layer of bed joint mortar may then be applied at stations 72 and 74 (FIG. 1**).

After the head joint and bed joint mortar has been applied to the blocks, table 171 is moved in the direction of the arrow 178 (FIG. 20) a distance equal to the nominal length of one of the blocks 74 plus the length of a nominal head joint. This advances the entire course as a unit. When the table is reciprocated in the opposite direction, a new block is pushed against the rearward face of the trailing block of the course and the process is repeated.

As described, the forward movement of the table 171, while a block rests frictionally on the rollers 154, allows the block on the rollers 154 to lag behind until the dogs 166 engage it and move it forward to the head joint forming position. However, if a half block is required in a course, the action as described would leave a half block space. To prevent this problem, a dog 182 similar to the dog 166 is pivoted on a pin 184 on the drawbar 170 and is spring-loaded upward. The dog 182 is placed at one-half a modular distance from the dog 166 to accommodate the engagement of a half block which may be substantially half the length of the block whose end is shown at 130 in FIG. 20 of the drawings. As shown best in FIG. 23, the table 171 comprises a channel shaped member in cross section which is supported for longitudinal movement on sets of rollers 186 which are journaled in the frame 60.

Figure 22:
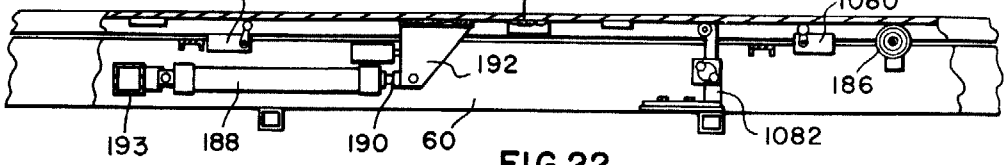

Before describing the specific manner of automatically compensating for half blocks, one first should understand the specifc means of advancing the course of blocks. A hydraulic cylinder 188 having a piston 190 is coupled between a bracket 192 fixed to the underside of the table 171 and a portion of the machine frame at 193 (FIG. 22). The hydraulic cylinder 188, when energized, extends the plunger 190 and moves the table 171 in the direction of the arrow 194 shown in FIG. 11. Subsequently energizing the cylinder 188 in the opposite direction retracts the plunger 190 and moves the table 171 in the direction of the arrow 178. This reciprocating action in combination with the clamping means 173 advances the course as a unit.

Figure 14:
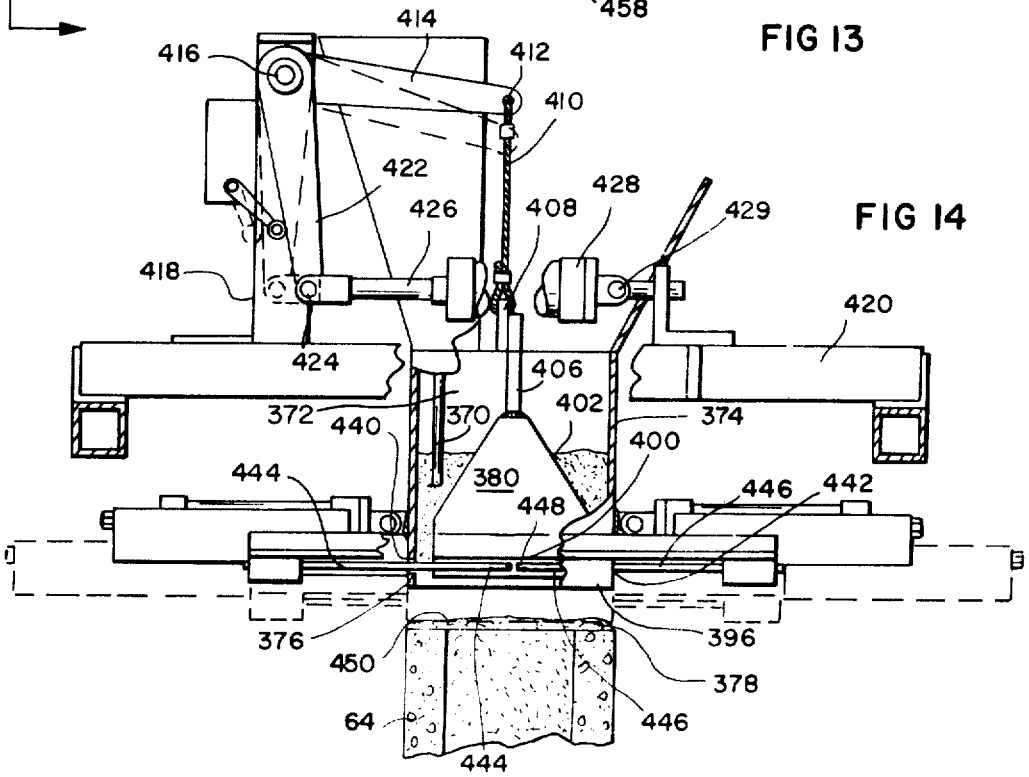
FIG. 14 is a fragmentary, sectional view along line 14—14 of FIG. 13.

The clamping means 173 is shown in FIGS. 19, 20, 21 and 22. The blocks 64 as shown in FIG. 14 of the drawings lie on top of the table 171 and are normally disposed adjacent to an edge 196 of a longitudinally extending guide bar 198 carried by the frame 60 of the machine. Thus, all of the blocks 64 and their head joints and bed joints are maintained in alignment against the straight edge 196.

The blocks are clamped against the edge 196 by means of a plurality of spring-loaded engaging studs 200 which are mounted in spaced-apart relationship along a longtudinally extending plate 201. The plate 201 and the engaging members 200 are pivotally connected by means of a series of pins 202 to levers 204 which, in turn, are pivoted by means of pins 206 to the frame 60. Pivotally connected to each lever 204 is a piston 210 of a hydraulic cylinder 212 whose other end is pivotally anchored to the frame 60. When the pistons 210 are extended, the respective levers 204 are pivoted on the respective pins 206 in a direction to carry the pivoted pins 202 away from the blocks 64 and consequently to disengage the clamp bolts 200 from the sides of the blocks 64 opposite to the straight edge 196. Thus, when the table 171 moves in a direction of the arrow 194 (FIG. 22), and it is desired to move the table 171 relative to the blocks, the cylinders 212 are energized to force the bolts 200 to engage the blocks 64 and to force them against the straight edge 196, the blocks are held in a stationary position while the table 171 slides beneath them back to the position as shown in FIG. 20 of the drawings, wherein the dog 166 is moved under the next successive block to engage it at its end 130 as shown in FIG. 20.

On the forward movement of the table 171, the clamping means 173 is released and the retraction of the plunger 190 of the hydraulic cylinder 188 moves the table 171, together with all blocks supported thereon together with the block engaged by the dogs 166, a distance equal to the modular length of the concrete block plus a head joint of mortar which is normally used to mortar blocks in end-to-end relationship with each other.

Figure 21:
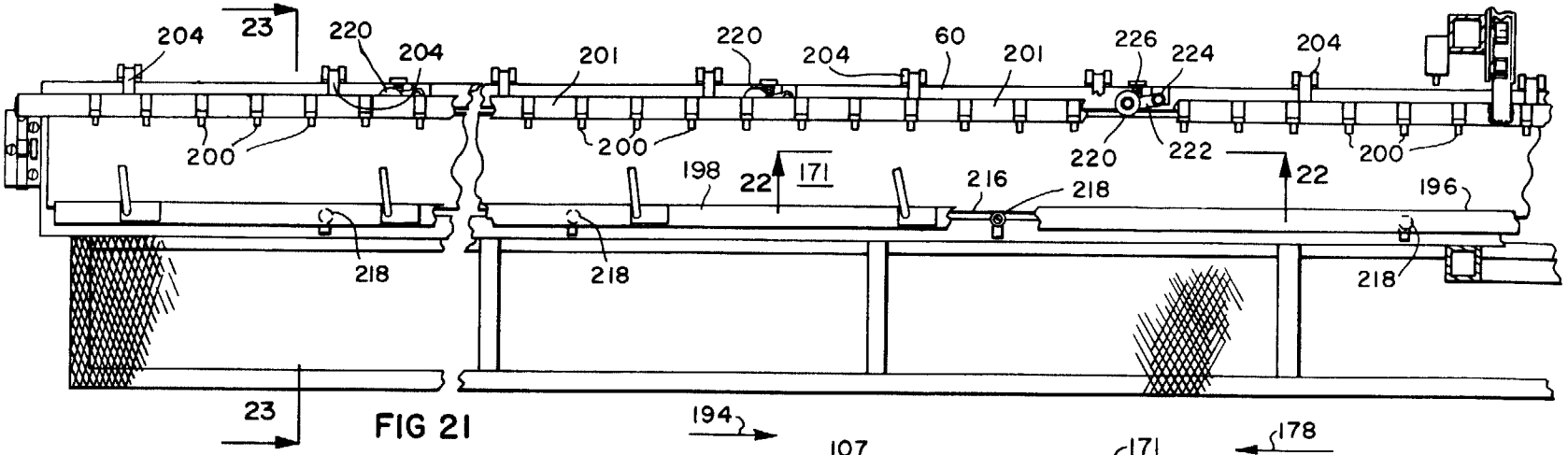
FIG. 21 is an enlarged, plan, sectional view along line 21—21 of FIG. 1.

In order that there is no skewing of the table 171 during its reciprocating movement, one edge 216 is engaged by idler rollers 218 spaced along the frame 60 so as to maintain the table 171 in alignment with the straight edge 196 (FIG. 21). Also, spring-loaded rollers 220 engage an opposite side of the makeup table 62 in opposed relation to the rollers 218. These rollers 220 are pivotally mounted on brackets 222 carried by pivot pins 224 connected to the frame 60 and the springs 226 force the rollers 220 against the side of the table 171 and hold it in firm engagement with the stationary idler rollers 218 forming parallel guides so that the table 171 slides precisely in parallel relationship with the straight edge 196.

When a half block is required in the course, it is placed on the conveyer 66 in the proper sequence and is conveyed into the receiving area 68. The half block presses against the plate 84 thus initiating the action of the pusher mechanism 70. Sensing of the half block is accomplished by an electric eye 227 which is supported on a bracket 229 attached to the main frame 60. As the push plate 113 is moved forwardly, a control switch 138 having an arm 142 is engaged by a lug 148 on the bottom of the plate 110. If at that point, the electric eye 227 is energized as by a block not being in the area of the eye 227, as would be the case when a half block is being pushed, a signal is generated which is transmitted by the action of switch 138 to a control circuit not shown. The plate 110 and its pusher plate 113 continue to move forwardly and push the half block against the next preceding block in the same manner as a full block and the switch 136 causes the push plate 113 to retract. However, in the case of a half block, it is pushed over and engaged by the set of dogs 182 shown in FIGS. 19 and 20. The control circuit in response to the half block signal of the electric eye then causes the hydraulic cylinder 188 to reciprocate table 171 on its next cycle a distance equal to a full block plus a head space and on the next following cycle a distance equal to a half block plus a head space. This causes the head space at the trailing edge of the half block to become aligned with the head joint filling station 72. Thereafter, the mechanism returns to a normal full block advancement until another half block is placed in the course.

Figure 5:
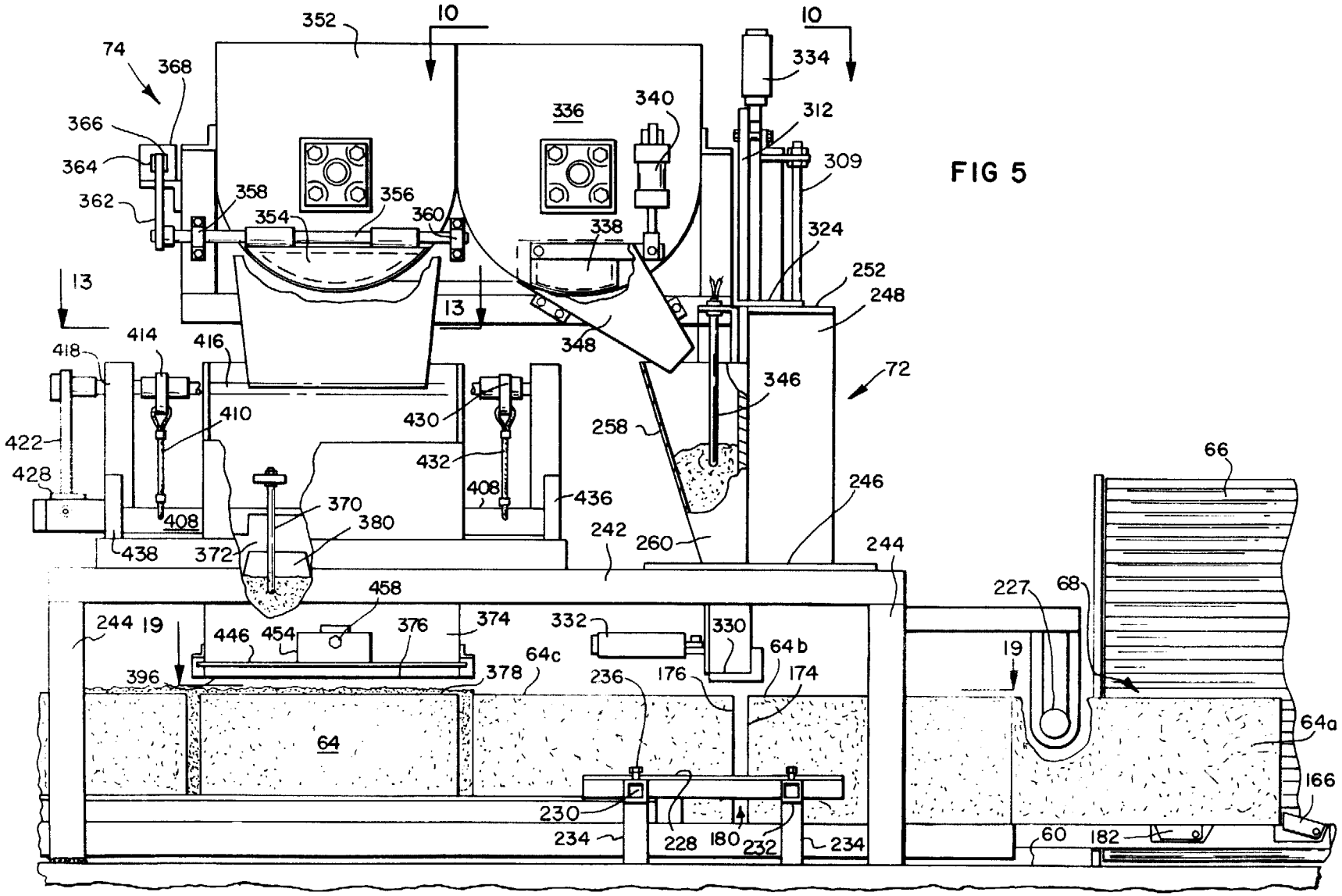
FIG. 5 is an enlarged, fragmentary, side elevational view along line 5—5 of FIG. 3.
Figure 19:
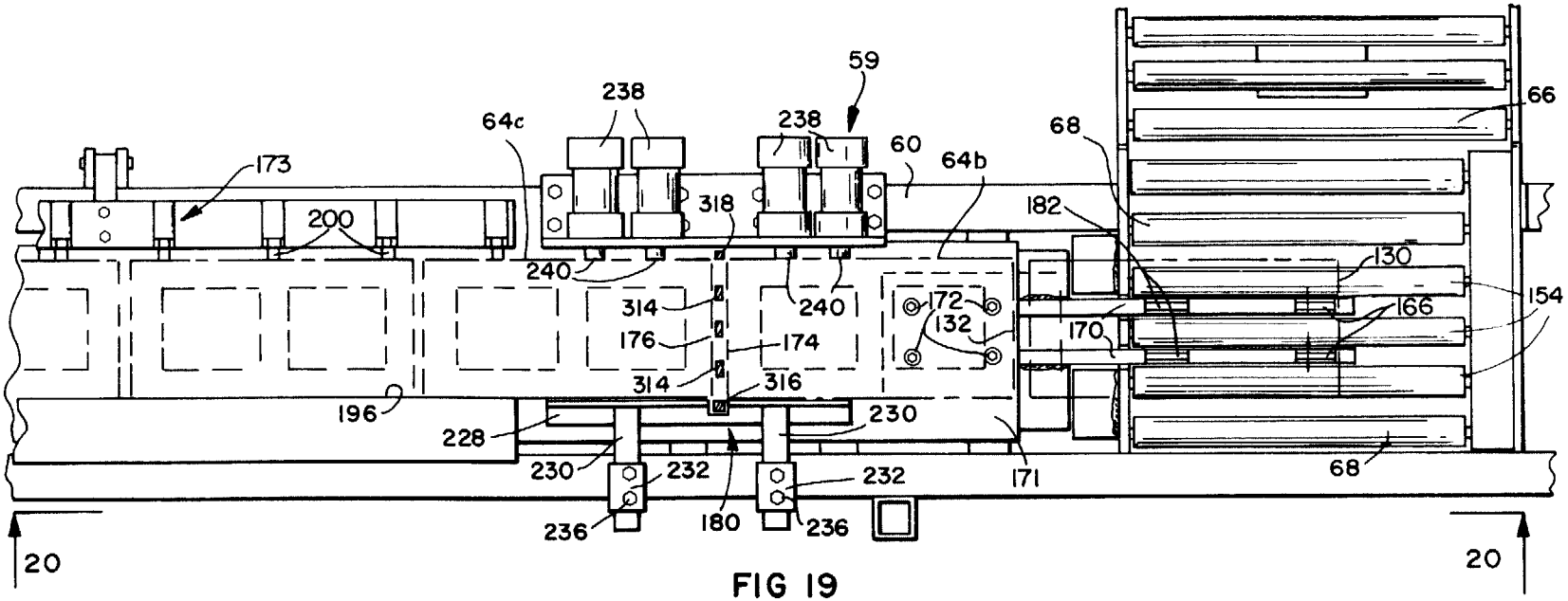
FIG. 19 is a fragmentary, plan, sectional view along line 19—19 of FIG. 5.
Figure 23:
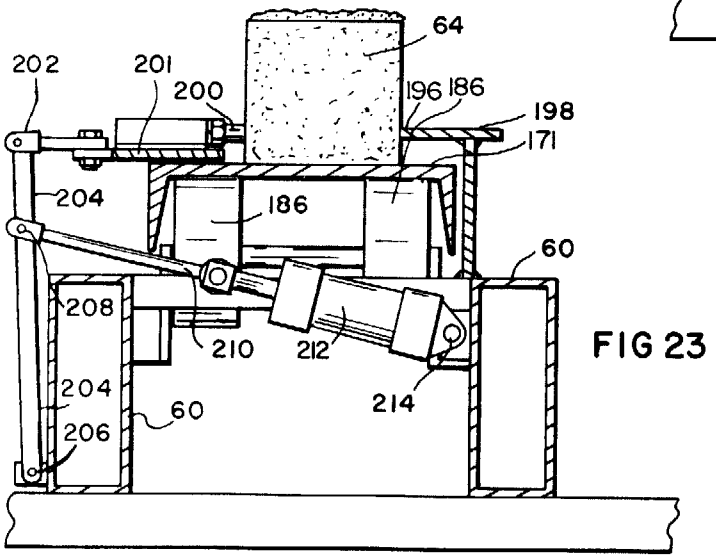
FIG. 23 is an enlarged, fragmentary, sectional view along line 23—23 of FIG. 21.

The head joint motar is applied at the head joint forming station after the blocks are properly spaced apart through the action of the table 171 and its associated dogs. Prior to applying the head joint mortar at the head joint space identified as 180 (FIG. 19) the blocks to be bridged by the head joint are rigidly clamped in position. A clamp bar 228 engages and overlaps the pair of concrete blocks whose ends are spaced apart at 174 and 176 (FIG. 19). The bar 228 is straight and is also shown in FIG. 5 of the drawings. The bar 228 is adjustably supported on arms 230 slidably mounted in tubular fixtures 232 supported on upstanding legs 234 (FIG. 5). The lower end of the legs 234 are supported on the main frame 60 at oone of its horizontal structural portions. Set screws 236 or the like secure the arms 230 in juxtaposition so that the bar 228 is properly aligned with the straight edge 196 of the member 198 (FIGS. 21 and 23).

Opposed to the bar 228 are a plurality of fluid actuated cylinders 238 supported on the frame 60. These cylinders 238 are provided with extendable plungers 240 adapted to engage the blocks 64 in opposed relation to the bar 228 while holding them in juxtaposition when a mortar head joint is formed at the position 180 between adjacent ends 174 and 176 of the blocks 64 (FIG. 19). Also see FIG. 5.

Disposed above the space 180 located between the ends 174 and 176 of the blocks 64 is the head joint forming mechanism 72 (FIG. 5). Details of this head joint forming mechanism are shown in FIGS. 5, 10, 11 and 12.

The mortar head joint mechanism 72 and the bed joint mechanism 74 are supported on an elevated horizontal frame structure 242. The frame 242 is supported on upstanding vertical legs 244 which extend upwardly from the main frame 60 and are fixed thereto. The head joint mortar dispenser station 72 is mounted on a supporting plate 246 which extends across horizontal frame members 242. Fixed to the plate 246 are a pair of upstanding frame plates 248 and 250 which support a horizontally disposed plate 252 in fixed relation therewith. A pair of vertical guide rods 254 and 256 are secured at their lower and upper ends respectively to the plates 246 and 252 and form vertical bearings for reciprocal movement of the mechanism for the head joint formation.

Figure 11:
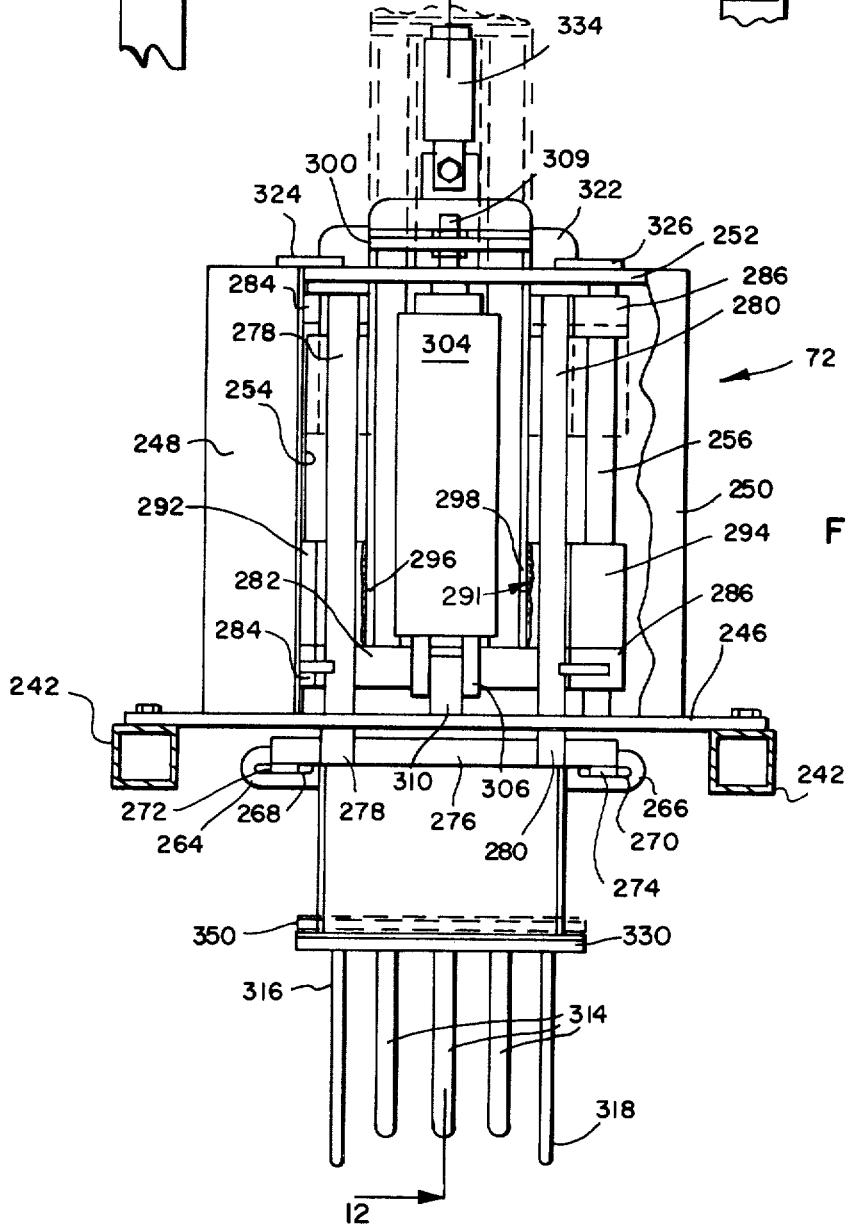
FIG. 11 is a fragmentary, sectional view along line 11—11 of FIG. 10.
Figure 12:
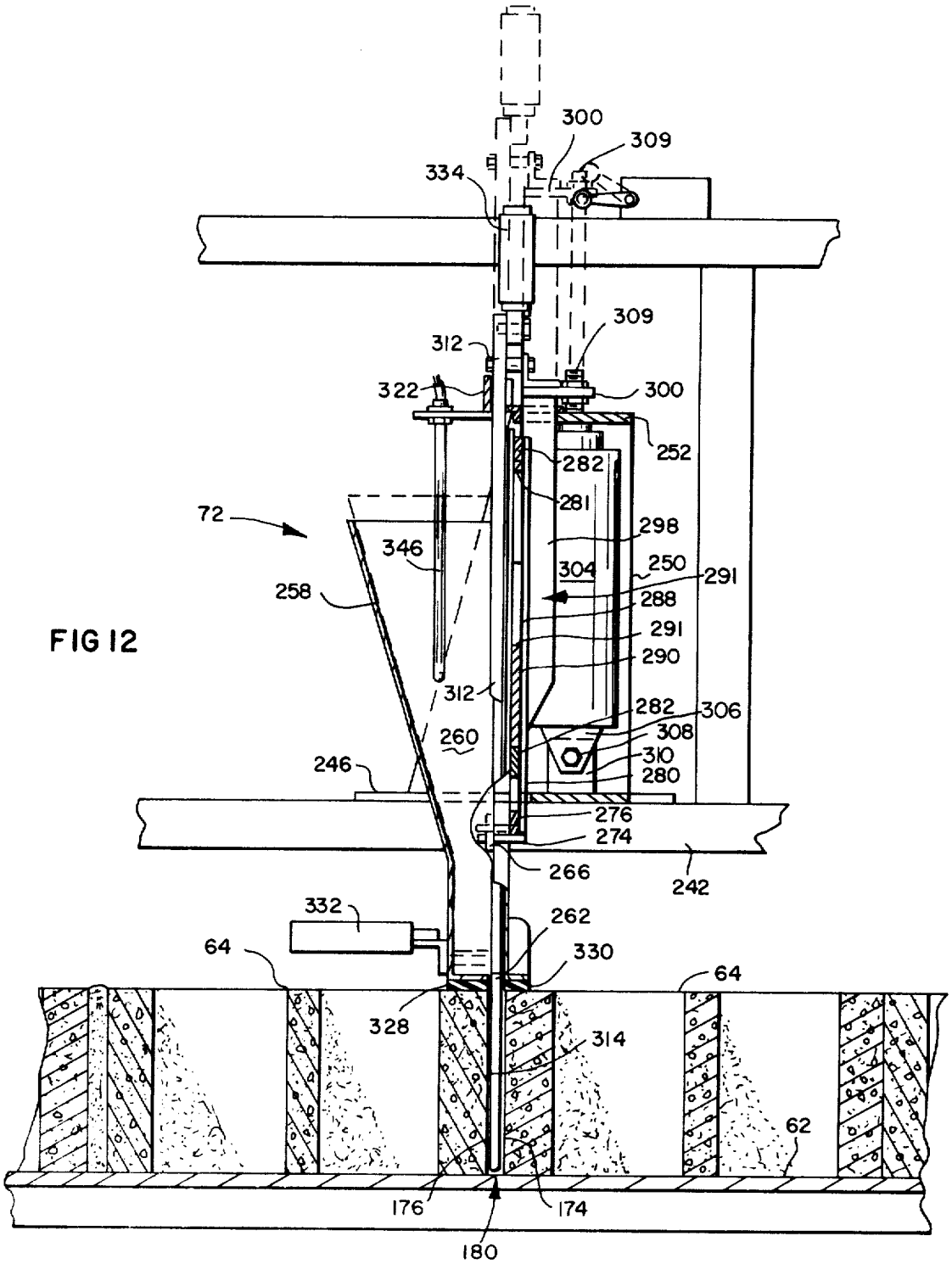
FIG. 12 is a sectional view along line 12—12 of FIG. 11.

A mortar receiving hopper 258 is provided with a downwardly converging spout 260 and a mortar outlet opening 262 (FIG. 12). In order to mount the hopper for vertical reciprocation on the rods 254 and 256, the hopper 258 is provided with supporting brackets 264 and 266 as shown in FIG. 11. The brackets 264 and 266 each include respective slots 268 and 270 in which are engaged fingers 272 and 274 on a cross support 276. The cross support 276 is connected to the frame for reciprocation by means of uprights 278 and 280 which are connected to a pair of spaced-apart yoke bars 282 and each of which has a pair of slide bearings 284 and 286 for engaging the guide rods 254 and 256 respectively.

Figure 10:
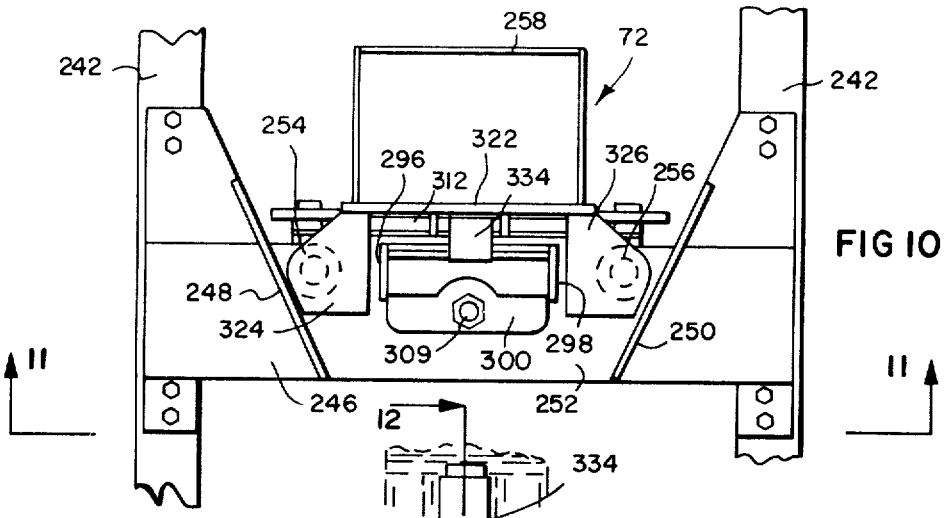
FIG. 10 is a fragmentary, plan view along line 10—10 of FIG. 5.

Intermediate the interconnected yoke bars 282, a third yoke bar 290 is provided which is slidably mounted by means of bearing portions 292 and 294 on the guide rods 254 and 256. Attached to the yoke bar 290 is a vertically extending frame 291 including a pair of straps 296 and 298 which supports a crossbar 300 (FIG. 10).

Vertical reciprocation of the frame 291 is accomplished by a hydraulic cylinder 304, one end of which is connected to the crossbar 300 at 309 and the oterh end of which is pivotally mounted by means of a bolt 308 and clevis 306 on a bracket 310 on the main frame plates 246. Extending the plunger of the hydraulic cylinder 304 raises the cross member 300 to an elevated position above the plate 252 as shown in dotted outline in FIG. 12.

The crossbar 300 carries a finger supporting plate 312 which is disposed inside of the hopper 258 for sliding movement along its flat surface. Secured to the lower end of plate 312 are three mortar feeding and vibrating fingers 314 as well as a pair of mortar retaining fingers 316 and 318. It will be seen that by reciprocation of plate 312 that the fingers 314, 316 and 318 carried by the plate will be retracted from the position shown in FIG. 11 to a position in which they are within the hopper 258. Thus, mortar is normally allowed to pass out of the outlet 262 around the finger 314 and between the fingers 316, 318 when they are in their downward position, as will be hereinafter described. In order to guide the plate 312 for vertical reciprocation, a bracket 322 is attached to portions 324 and 326 of the plate 252 to provide a slot in which the plate 312 can slide.

It will be seen that when the plunger of the hydraulic cylinder 304 is retracted into its downward, solid line, position as shown in FIG. 12, the yoke bars 282 together with the crossbar 276 which supports the hopper 258 are allowed to slide downwardly on the guide bars 254 adn 256 so as to allow the lower end 328 of the hopper 258 to carry an attached resilient gasket 330 into engagement with the upper surface areas of the ends of blocks 64. The gasket 330 is adapted to prevent mortar from leaking out onto the upper surfaces of the blocks. Thus, when the plunger 309 of the cylinder 304 is retracted downwardly, it first allows the gasket 330 to bear on the upper surfaces of the blocks 64 adjacent their spaced-apart ends 174 and 176 and then causes the fingers 314, 316 and 318 to move into the space 180 between the blocks. A vibrator 332 is provided to vibrate a lower portion of the hopper 258 in order to feed mortar rapidly and a vibrator 334 is attached to vibrate the plate 312 and the fingers 314, 316 and 318.

Mortar is fed into the hopper 258 from a batch mixer 336 (FIG. 5) whose outlet gate 338 is opened by means of a hydraulic cylinder 340. A probe 346 in the hopper 258 senses the level of mortar in the hopper 258 and causes operation of the cylinder 240 to incrementally add mortar to the hopper 258 as required.

In operation, the blocks 64 are moved to place the head space opening 180 under the head joint station 72. At this time the hydraulic cylinder 304 has the crossbar 300 raised to its maximum height so that the fingers 314, 316 and 318 are retracted inside the hopper 258 and the bottom of the hopper is raised to the position shown by the dotted outline 350 in FIG. 11. The hydraulic cylinder 304 is actuated to lower the crossbar 300. This first causes the gasket 330 along with the hopper 258 to move downwardly to seal the upper opening of the head space between the blocks. Thereafter, the fingers 314, 316 and 318 are moved downwardly between the blocks, the fingers 318 located and proportioned to seal the outer vertical edges of the head space openings and thus prevent mortar from exuding out the sides of the head space. After thhe fingers are in the fully lowered position, the vibrators 332 and 334 are actuated. The vibrator 332 causes mortar to flow through the opening in the bottom of the hopper and the vibrator 334 causes the fingers 314, 316 and 318 to vibrate between the blocks. As the head is filled with mortar the cylinder 304 is actuated to raise the bar 300 thus withdrawing the fingers from between the blocks and completing the mortar joint. Finally, after the fingers are completely withdrawn, the vibrators 332 and 334 are deactivated so that no more mortar will flow. The vibrating of the fingers 314, 316 and 318 provides a compacted, substantially uncompressible joint between the blocks which results, after curing in a rigid high-strength wall.

The bed mortar forming and laying station 74 is shown in FIGS. 1, 5, 13, and 14. This station provides a horizontal layer of mortar on top of a block positioned one block downstream of the head joint station 72 (FIG. 5). As the blocks are advanced under the bed joint laying station 74, a layer of mortar successively is automatically deposited on the top of each block 64.

Figure 13:
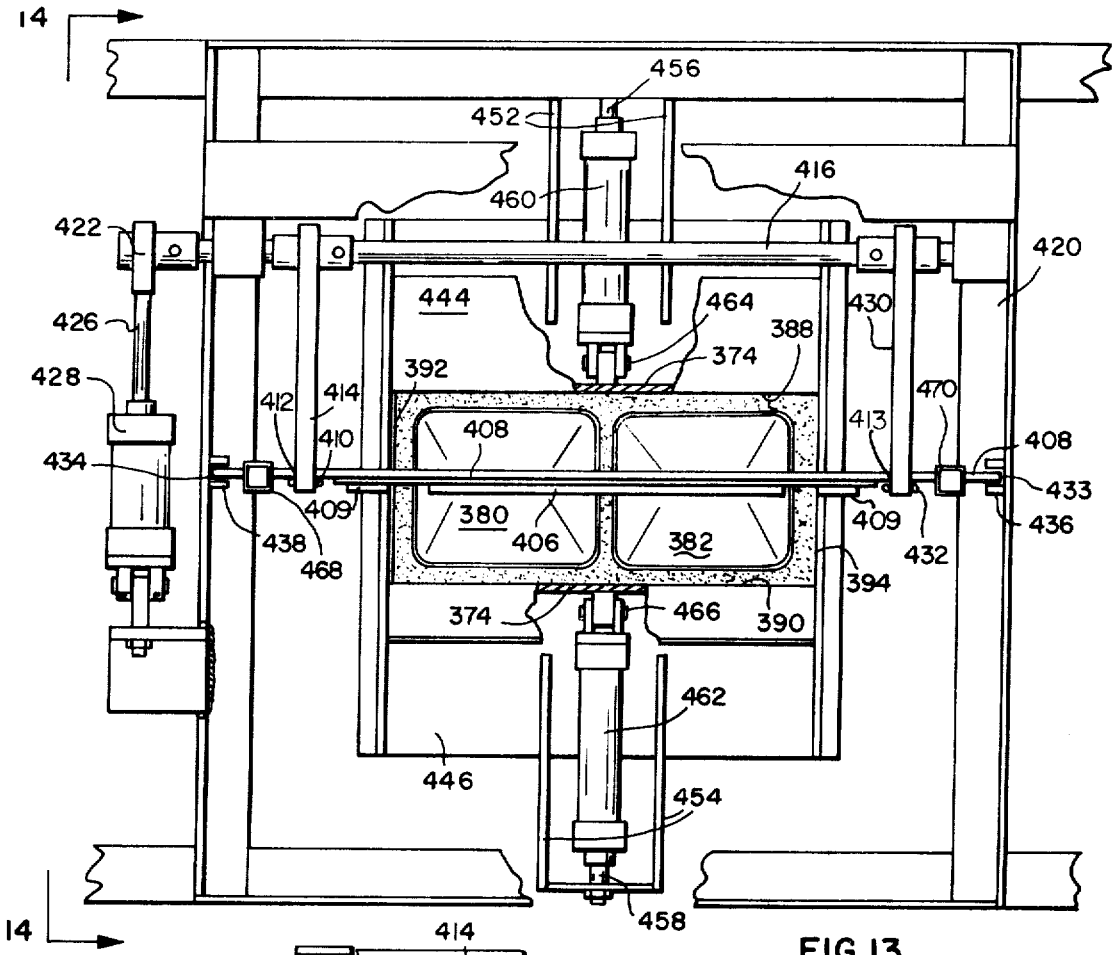
FIG. 13 is an enlarged, fragmentary, sectional plan view along line 13—13 of FIG. 5.

Referring to FIG. 5 of the drawings, it will be seen that the mortar bed laying station 74 includes a batch mixer 352 having an outlet door 354 carried by a shaft 356 pivotally mounted in axially horizontal bearings 358 and 360 secured to the end of the batch mixer 352. Coupled to the shaft 356 is a bell crank arm 362 which is coupled at its extended end 364 with a plunger 366 of a hydraulic cylinder 368. This cylinder 368 is controlled by electric circuitry coupled to a mortar sensing probe 370 in a bed hopper 372 which receives mortar from the batch mixer outlet door 354. Thus the mortar sensing probe 370 controls flow of mortar into the hopper 372. A bed box structure 374 around the hopper 372 is provided with a lower outlet 376 adapted to move down into close proximity with the upper surface 378 of a concrete block 64 during placement of mortar on its upper surface. FIG. 13 is a plan sectional view showing the bed box 374 wherein a pair of core members 380 and 382 are suspended so as to coincide with normal core openings in concrete blocks. The core members are spaced from the side walls 388, 390, 392, and 394 of the bed box 374 so as to provide an open space around the core members 380 and 382 which is substantially the shape of a top edge of a concrete block.

The bottom portions of the cores 380 and 382 are disposed slightly above the outlet 376 and the cores 380 and 382 are provided with substantially vertical sides 400 (FIG. 14) extending upwardly into generally frusto-conical portions 402. These frusto-conical portions 402 are interconnected by a bar 406 for maintaining the cores 380 and 382 in position. The bar 406 is secured to a bar 408 which is attached to the hopper walls at 409 and the bar 408 is suspended by cables 410 and 432 connected to ends 412 and 413, respectively, of levers 414 and 430 which are fixed to a shaft 416. The shaft 416 is pivotally mounted on an upstanding member 418 of a horizontal frame structure 420 supported on the frame structure 242 (FIG. 5).

to the shaft 416 is another lever 422 having a pivot pin 424 connecting the plunger 426 of a hydraulic cylinder 428 with the lever 422. The hydraulic cylinder 428 is pivotally mounted on a pin 429 carried by the frame 420. The bar 408 at its opposite ends 433 and 434 is movable vertically in channel guides 436 and 438 carried by the frame 420. This construction permits the entire hopper 372 and the associated bed box 374 to move vertically in response to activation of the cylinder 428.

The bed box 374, near its lower outlet 376 and at its opposite side walls 388 and 390, is provided with horizontally disposed slots 440 and 442 (FIG. 14). The slots 440 and 442 slidably support mortar cutoff plates 444 and 446 which are proportioned so that their adjacent ends meet at 448 at the center of the bed box below the core members 380 and 382 to shut off the flow of mortar at the proper point in the operation.

Attached to the cutoff plates 444 and 446 are brackets 452 and 454 which are adapted to be connected to hydraulic cylinders 460 and 462 respectively. The cylinder 460 is coupled at one end to the bracket 452 and is coupled at its other end by a pivot pin 464 to a side 388 of the bed box 374. The hydraulic cylinder 462 is coupled at one end to the bracket 454 and is coupled at its other end by means of a pin 466 to the side 390 of the bed box 374 (FIGS. 13 and 14). Thus, energization of the cylinders 460 and 462 causes extension of the plungers 456 and 458, and retraction of the cutoff plates 444 and 446 from the central location 448 shown in FIG. 14 to clear the opposite inner sides 388 and 390 of the bed box (FIG. 13). In this posiiton, the entire mortar area around the cores 380 and 382 is exposed so as to conform with the shape of the upper edge surface 378 of a concrete block 64 as shown in FIG. 14 and at this time conventional vibrators 468 and 470 may be activated to vibrate the bed box as well as the bar 408 and the cores 380 and 382 to feed the mortar downwardly therearound and onto the upper surface of the concrete block when the lower open end 396 of the bed box is disposed at the upper surface 378 of the concrete block 64.

After the bed mortar is laid, the cutoff plates 444 and 446 are closed by activation of the cylinders 460 and 462. The closing action is desirably rapid and is timed to occur concurrently with the raising of the bed box 378 by the hydraulic cylinder 428 and the cables 410 and 432. This action results in a clean deposition of mortar without wiping off the bed joint in the marginal areas of the block. In the event a half block is in the course, the bed box 374 is moved into an area which is already half covered with bed mortar and, as a consequence, no substantial amount of additional mortar is deposited.

The head joints may be manually troweled if desired, however, the troweling or striking of the head joints may be accomplished automatically at the head joint striking station illustrated (FIGS. 15, 16, 17 and 18). The head joint mortar striking station 75 is located adjacent to the bed joint station 74 and downstream thereof.

Figure 17:
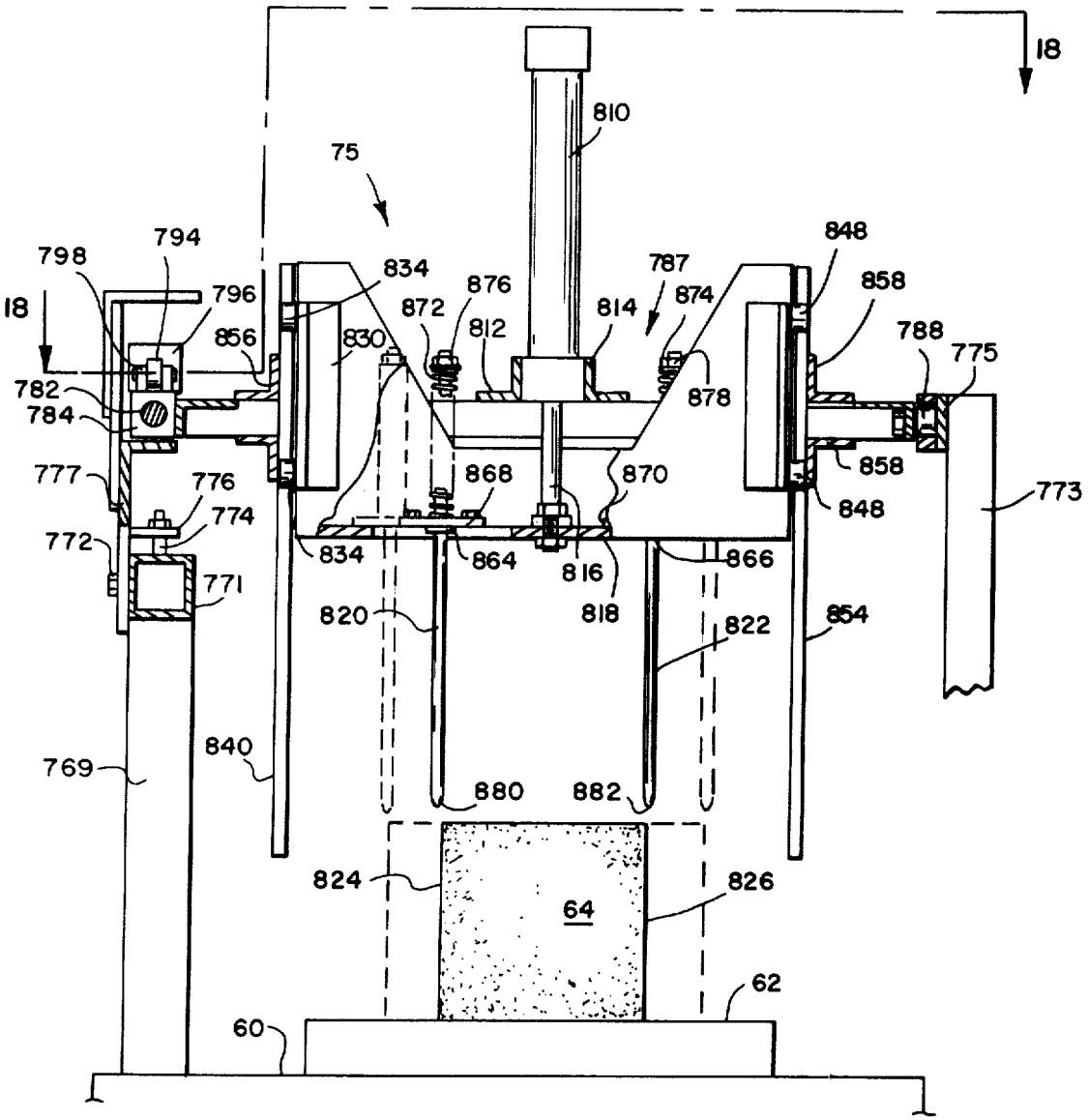
FIG. 17 is a fragmentary, sectional view along line 17—17 of FIG. 15.

The head joint strike mechanism is supported on upstanding frame members 769 attached to the main frame 60. The upwardly extending members 769 are interconnected by horizontal member 771. As shown in FIG. 17 an upstanding frame member 773 extends from the main frame 60 and supports a horizontal track 775 which supports one side of the head joint mortar strike mechanism.

Supported on thehhorizontal member 771 is a carriage frame 777 having elongated slots 767 and 768 through which bolts 770 and 772 extend and which adjustably secure the frame 777 to the horizontal frame member 771. The horizontal member 771 is also provided with upstanding bolts 774 extends through tabs 776 on the frame 777 as shown best in FIG. 17 of the drawing so as to provide for adjustability of the frame 777 relative to the frame 771.

Figure 15:
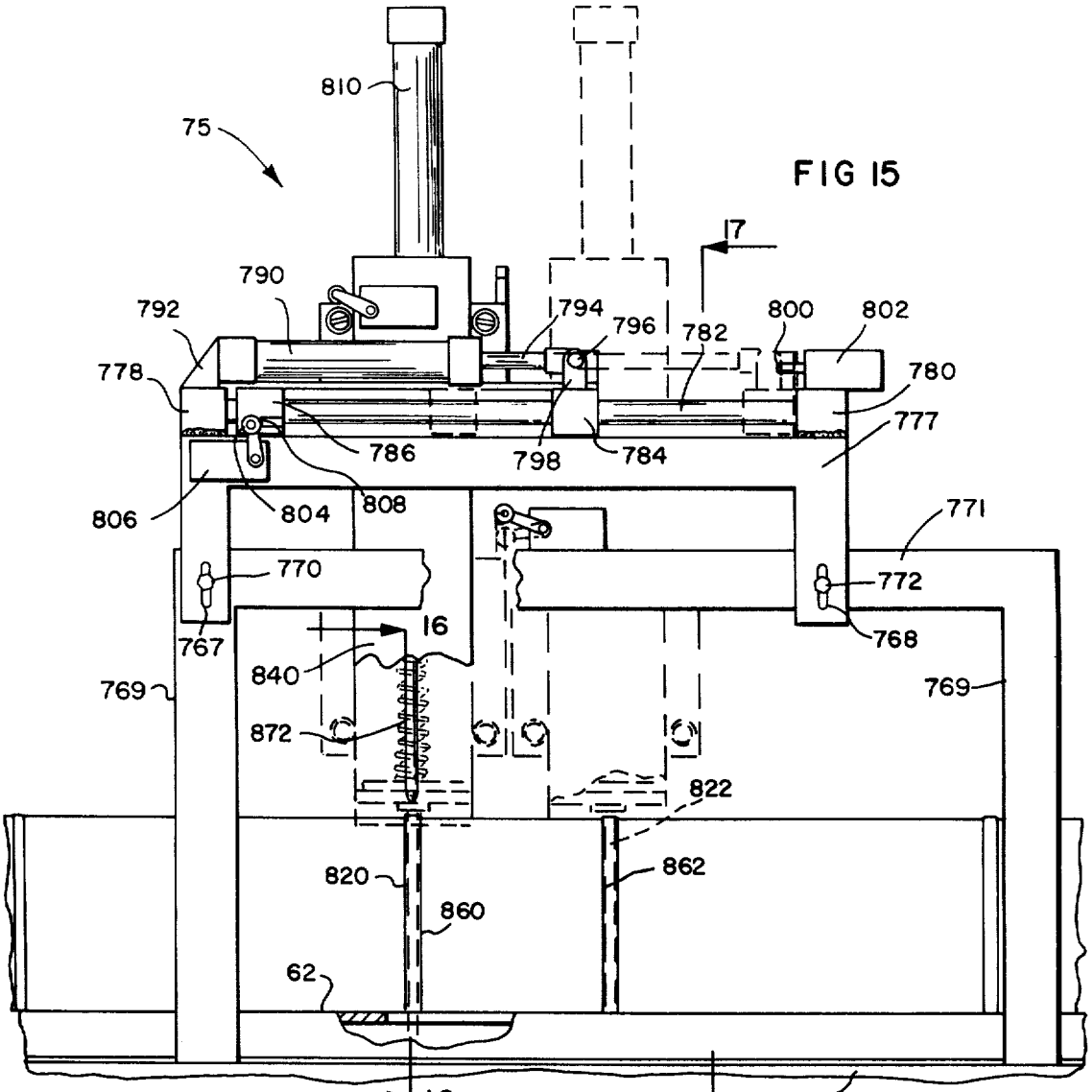
FIG. 15 is an enlarged, fragmentary, sectional view along line 15—15 of FIG. 2.
Figure 18:
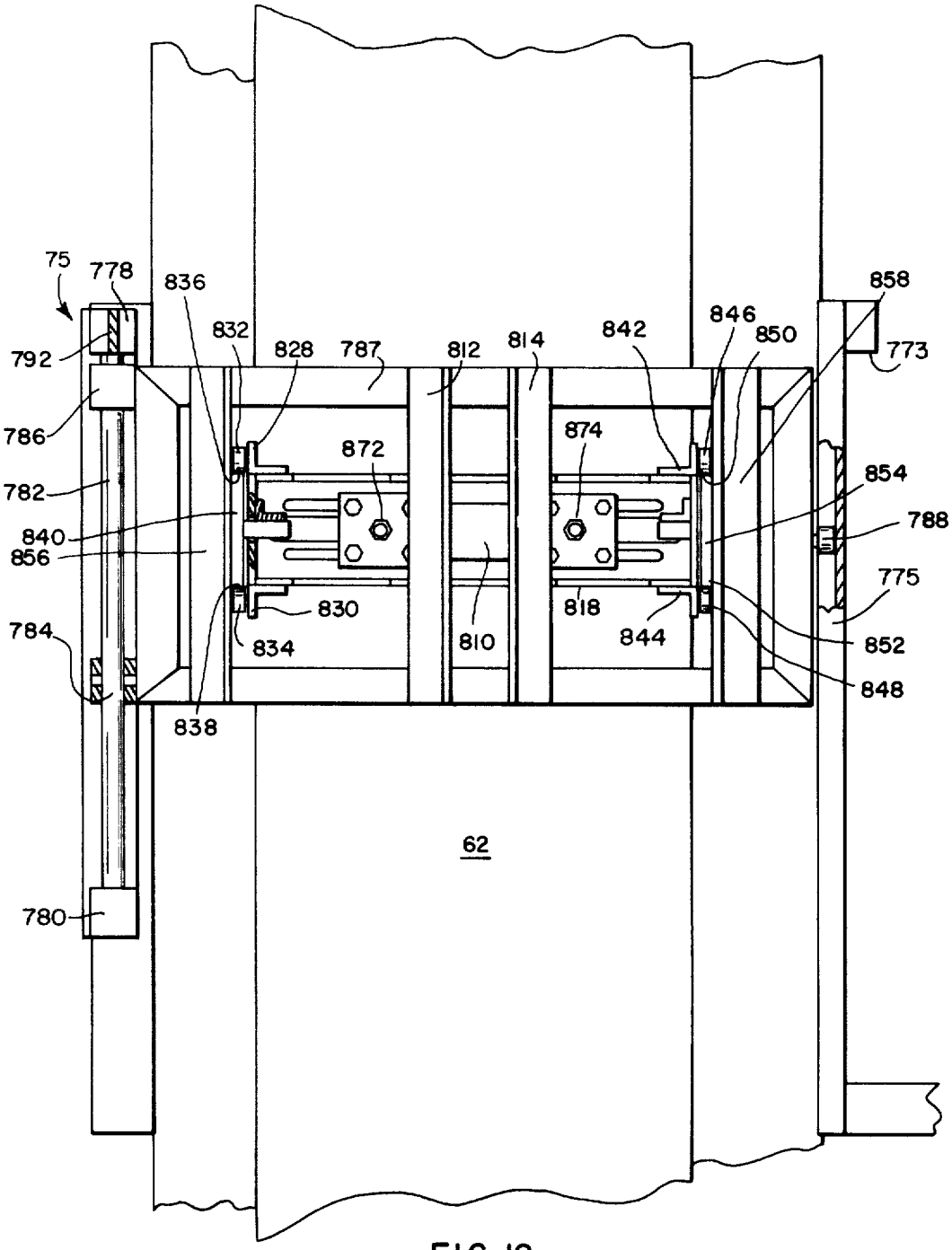
FIG. 18 is a plan view along line 18—18 of FIG. 17.

As shown in FIG. 15, the frame 777 is provided with a pair of rod supports 778 and 780, between which is supported a rod 782 on which bearings 784 and 786 of a carriage 787 are slidably mounted. The carriage 787 is provided with rollers 788 which ride in the track 775 (FIGS. 17 and 18).

A hydraulic cylinder 790 is mounted on a bracket 792 on the frame, the cylinder being provided with an extendable plunger 794 coupled by means of a pin 796 to an upstanding bracket 798 on the slide bearing 784. (The structure shown in section in FIG 18 omits the cylinder 790 for clarity.) The cylinder 790 and its plunger 794 move the slide bearing 784 together with the carriage frame 787 to a broken-line position shown in FIG. 15 of the drawings whereupon a plunger 800 of an electrical switch 802 is engaged to de-energize the cylinder 790. An arm 804 of a control switch 806 is disposed to be engaged by a lug 808 on the slide bearing 786 when the slide bearing 786 and carriage 787 is in the solid-line position, thus de-energizing the cylinder when the plunger 794 moves to a retracted position.

Mounted on the carriage 787 is a hydraulic cylinder 810 which is carried by cross members 812 and 814 of the carriage frame 787. This hydraulic cylinder 810 is provided with a downwardly extendable plunger 816 which is coupled to a finger frame 818 which carries mortar strike fingers 820 and 822. The fingers 820 and 822 are vertically disposed and adapted to strike head joint mortar between adjacent ends of concrete blocks 64 in close proximaity to opposite sides 824 and 826 of the blocks 64.

The finger frame 818 is provided with vertical bars 828, 830 at one end thereof. The bars 828, 830 carry opposed rollers 832 and 834 respectively which traverse opposite edges 836 and 838 of a vertical track 840. The opposite end of the finger carriage 818 is provided with vertical bars 842 and 844 carrying rollers 846 and 848 respectively which traverse edges 850 and 852 of a vertical track 854. The tracks 840 and 854 are suspended from the carriage frame 787 by cross members 856 and 858 respectively, there being a pair of the members 856 and a pair of the members 858 as shown in FIG. 17 of the drawings. The rollers 832, 834, 846 and 848 all are in pairs and vertically spaced from each other to provide rectilinear guides to follow the tracks 854 as the finger carriage 818 moves upwardly and downwardly relative to the frame 787.

Referring to FIG. 15 of the drawings, it will be seen that when the hydraulic cylinder 790 has been energized, from the solid-line position to the broken-line position, that the strike fingers 820 and 822 move from a position designated 860 to a position designated 862. The distance between these positions is equal to half the modular length of one of the blocks 64 and thus equals a half block so that shifting of the finger carriage 818 together with the carriage 787 from the position 860 to the position 862 as shown in FIG. 15 is accomplished depending upon the desired disposition of mortar head joints in the courses of blocks on the makeup table 62. It will be understood that the vertical mortar joints are offset 8 inches in successive courses of blocks and, accordingly, actuation of the cylinder 790 and operation of the switches 802 and 806 provides for control of the cylinder 790 for bringing the fingers 820 and 822 into the different positions 860 and 862 shown in FIG. 15 of the drawings. The hydraulic cylinder 790 is actuated to move the striker mechanism to the dotted line position shown in FIG. 15 incident to the electrical signal generated by the photocell 227 and the switch 138 as has been described. The control circuitry for the mechanism then counts the movements of the table 171 and when the half block has passed the striker station the cylinder 790 is actuated to return the mechanism to the solid line position.

Figure 16:
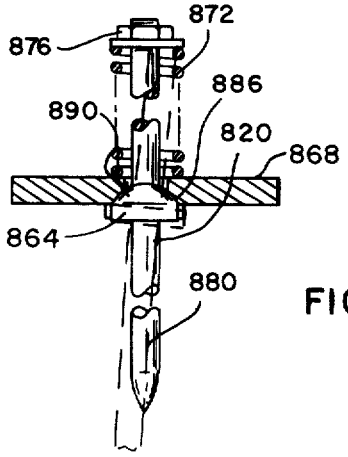
FIG. 16 is an enlarged, fragmentary, sectional view along linen 16—16 of FIG. 15.

It will be seen that the fingers 820 and 822 are provided with respective bearing shoulders 864 and 866 which bear against mounting plates 868 and 870 carried by the finger carriage 818. Springs 872 and 874 bear upon the upper surfaces of the mounting plates 868 and 870 and screw threaded nuts 876 and 878 retain the springs 872 and 874 against the mounting plates 868 and 870 so that the fingers 820 and 822 may flex slightly in a lateral direction as they move downward into the mortar of the head joint between the blocks 64. Lower ends 880 and 882 of the fingers 820 and 822 are tapered so as to readily seek an alignment position between adjacent ends of the blocks 64 at their sides 824 and 826. As shown in FIG. 16 of the drawings, the mounting plate 868 is provided with a substantially hemispherically shaped socket 886 with which the shoulder 864 is engaged. The shoulder 864 is a spheroidal surface 890 conformally seated in the spheroid socket 886 so that the finger 820 may readily flex relative to the mounting plate 868 when the tapered end 880 of the finger 820 seeks a position in the head joint mortar between adjacent ends of the blocks 64 at their opposite sides 824 and 826 as indicated in FIG. 17 of the drawings. Like structure is common to the finger 822. The diameters of the fingers 820 and 822 are proportioned so that an arcuate, inwardly directed indentation is formed in the head joint as shown in the drawings. (The dotted line outline of the position of the fingers 820 and 822 (FIG. 17) represents the position of the fingers for a wider block.)

Figure 46:
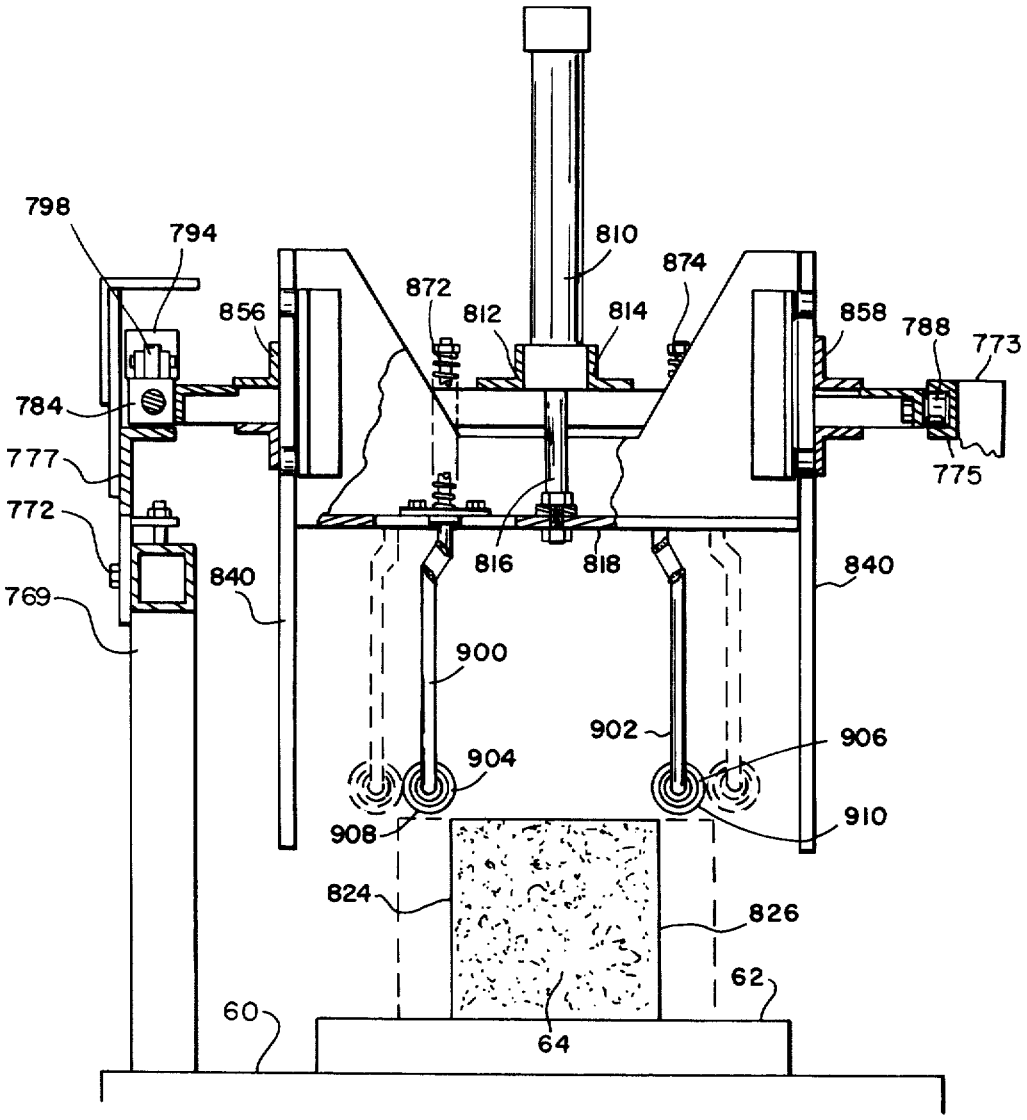
FIG. 46 is a view similar to FIG. 17 but showing a modified structure.

Referring to FIG. 46 of the drawings, it will be seen that a pair of fingers 900 and 902 are provided with mortar-striking rollers 904 and 906 rotatably mounted thereon. These rollers are provided with peripheries 908 and 910 adapted to strike head joint mortar at opposite sides 824 and 826 of the concrete blocks 64. (The dotted line outline of the position of the fingers and rollers indicates the position for a wider block.)

With the exception of the rollers 904 and 906, the fingers 900 and 902 are similar to the hereinbefore described fingers 820 and 822 and are carried and mounted in substantially the same manner and spring loaded as hereinbefore described.

In making up a course of blocks, unmortarted blocks are fed in a predetermined manner to the infeed station 58 which delivers them to the makeup station 59. Half blocks may be placed in the course as necessary and this is automatically compensated for by the electric eye 227 and switch mechanism 138 which has been described. It will be seen from the previous description that the reciprocating table 171 moves on each cycle the modular length of a block or half block plus the length of a nominal head space as required, Building blocks are not made to exact tolerances and they may vary as much as an eighth of an inch or more from a predetermined size. With the mechanism which is described, these irregularities are compensated for in the head space. Movement of the table 171 as described, insures that the block being fed to the makeup station 59 is seated against either the dogs 166 or 182 which places the trailing edge of the block in a fixed position in relation to the course thereby insuring that irregularities in the block do not increase or decrease the length of the course from a multiple of the selected module. Instead, any irregularities are taken up in each head joint before the course is advanced.

As the blocks are advanced along the table 171 through the reciprocation of the table and the clamping means 173 together with the clamping action of the hydraulic cylinders 238 at the head joint filling mechanism 72, the blocks first come under the head joint filling station 72 where the head joints are made sequentially; then move to the bed mortar station 74 which sequentially applies a layer of bed mortar for the course; and finally to a head joint striker station 75 where excess mortar is struck or troweled from the vertical head joints. The completed course is progressively moved through the equipment in rigid alignment until the desired number of blocks are placed in the course. At that time, the blocks in the form of a mortared course lie on the table in a position where they can be engaged by the transfer station 63.

After a course of blocks is formed as described above, it is then moved from the table 171 to the panel assembly station 65 by means of the transfer station 63. While the courses made in the mechanism may be applied to either the top or the bottom of previously formed and assembled courses, in the illustrated embodiment, the courses are applied to the top of previously assembled courses.

The transfer station 63 includes a transfer carriage 478 which is adapted to rigidly clamp on entire course of blocks with their head and bed joints as they are disposed in line on the table 171, after which, the course as a unit, is lifted vertically to clear the top of any courses already in the panel being formed, after which the transfer carriage 478 is shifted laterally into alignment with the panel being formed whereupon it is lowered into alignment with the wall panel being formed to deposit the course of blocks on top of a previous course.

In order to permit vertical movement of the transfer carriage 478, it is movably mounted in a frame 479 which includes upright frame members 480 and 482 which are interconnected at their upper ends by a structural member 488, the lower ends of members 480 and 482 being set in fundation structures 484 and 486 respectively (FIGS. 1, 29–32).

Figures 24, 25:
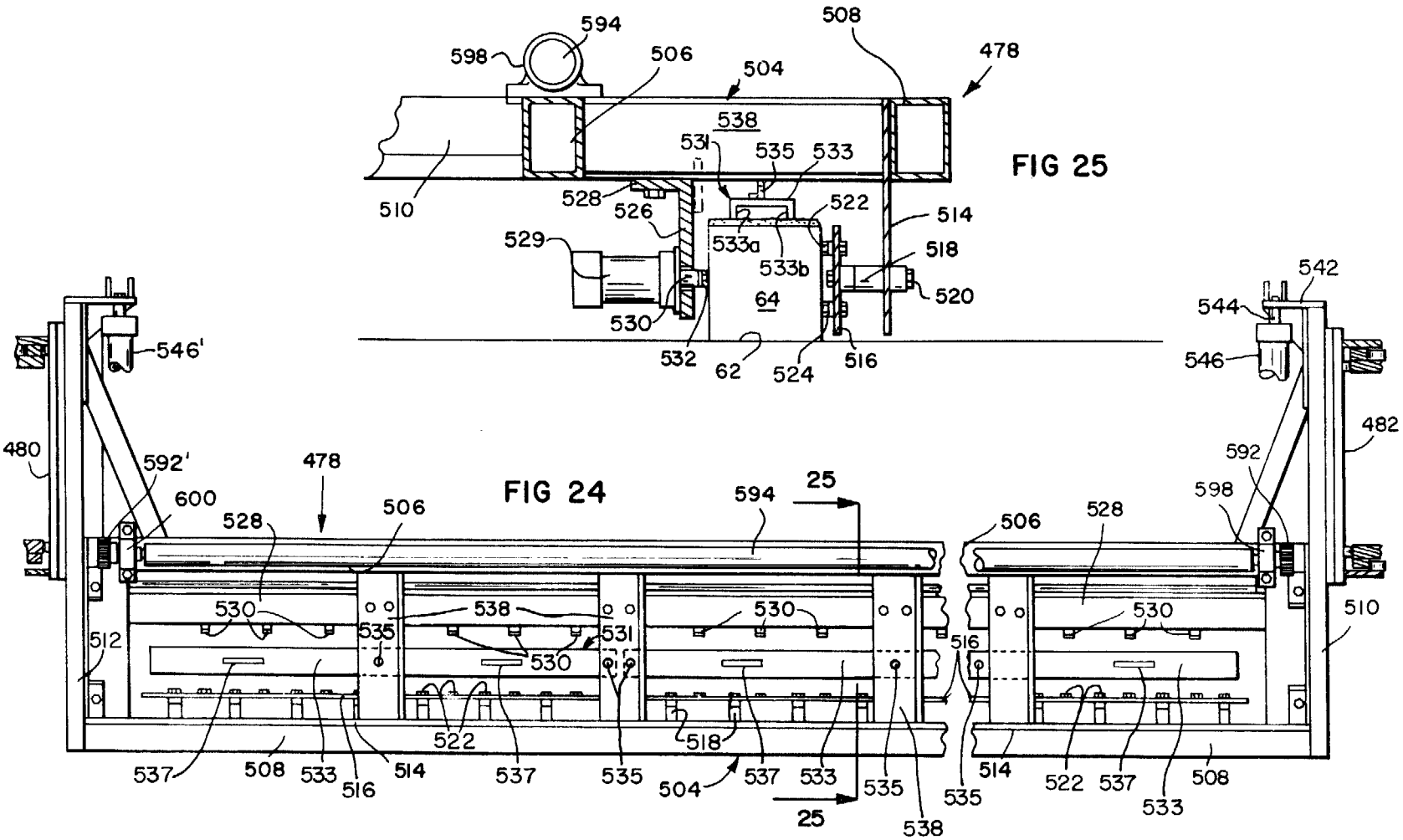
FIG. 24 is an enlarged, fragmentary, plan sectional view along line 24—24 of FIG. 1.
FIG. 25 is an enlarged, fragmentary, sectional view along line 25—25 of FIG. 24.

The transfer carriage 478 includes a frame 504 having side members 506 and 508, and end members 510 and 512 (FIG. 24).

The carriage 478 includes means for picking up the course of blocks. As shown in FIG. 25, a downwardly suspended plate 514 is attached to frame member 508. The plate 514 extends the length of the carriage and has an elongated clamping plate 516 secured thereto. The clamping plate 516 is adapted to engage one side of the course of blocks to be transferred. The plate 516 is disposed in a substantially vertical disposition and is secured to the plate 514 by means of spacers 518 and bolts 520.

Fixed to clamping plate 516 are block-engaging bolts 522 and 524, there being a row of bolts 522 at an upper elevation and a row of bolts 524 at a lower elevation adapted to engage a side of each concrete block in the course to be handled at spacer apart elevations. The rows of engaging bolts 524 and 522 may be adjusted to provide a flat reference plane for one side of the course.

Spaced laterally from clamping plate 516 is an angle member 528 which extends the length of the carriage 478 and which is attached to end frame members 510 and 512. The member 528 is disposed with a downwardly extending web 526 which carries a plurality of hydraulic cylinders 529 having extendable plungers 530. The plungers 530 are provided with block-engaging tips 532 which are adapted to be biased against one side of the block course being picked up so as to clamp the course between the rows of engaging bolts 524 and 522 and the tips 532. It should be noted that the plungers 530 are spaced closely enough together so as to engage each of the blocks or half blocks in a course for maintaining them all in juxtaposition as they are transferred (FIG. 4).

The frame 504 is movable horizontally from a position over the table 171 to a position over a pallet on which the panel is to be built, as well as vertically to clear the top of the panel being formed.

Figure 26:
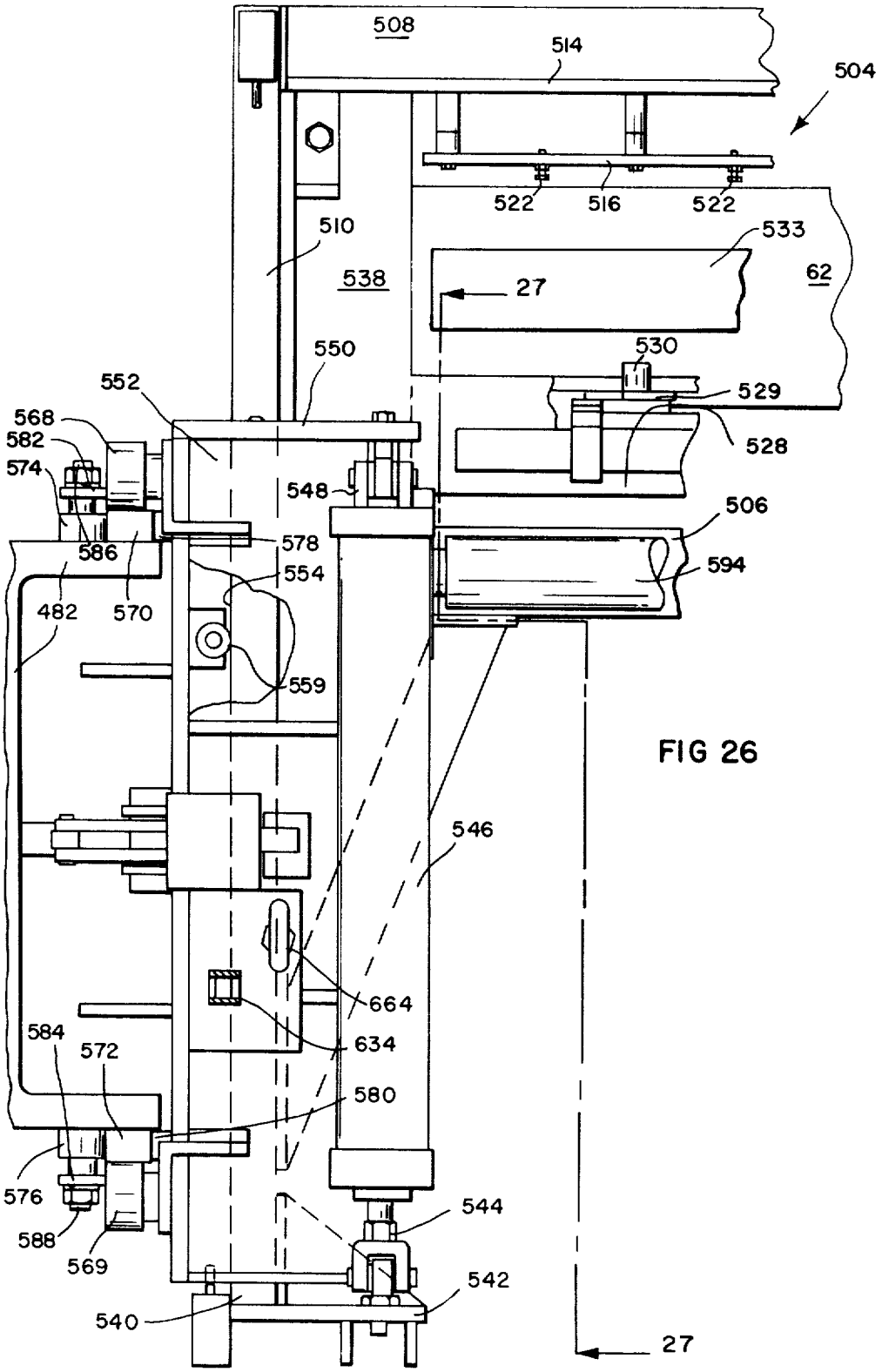
FIG. 26 is an enlarged, fragmentary, plan sectional view along line 26—26 of FIG. 1.
Figure 27:
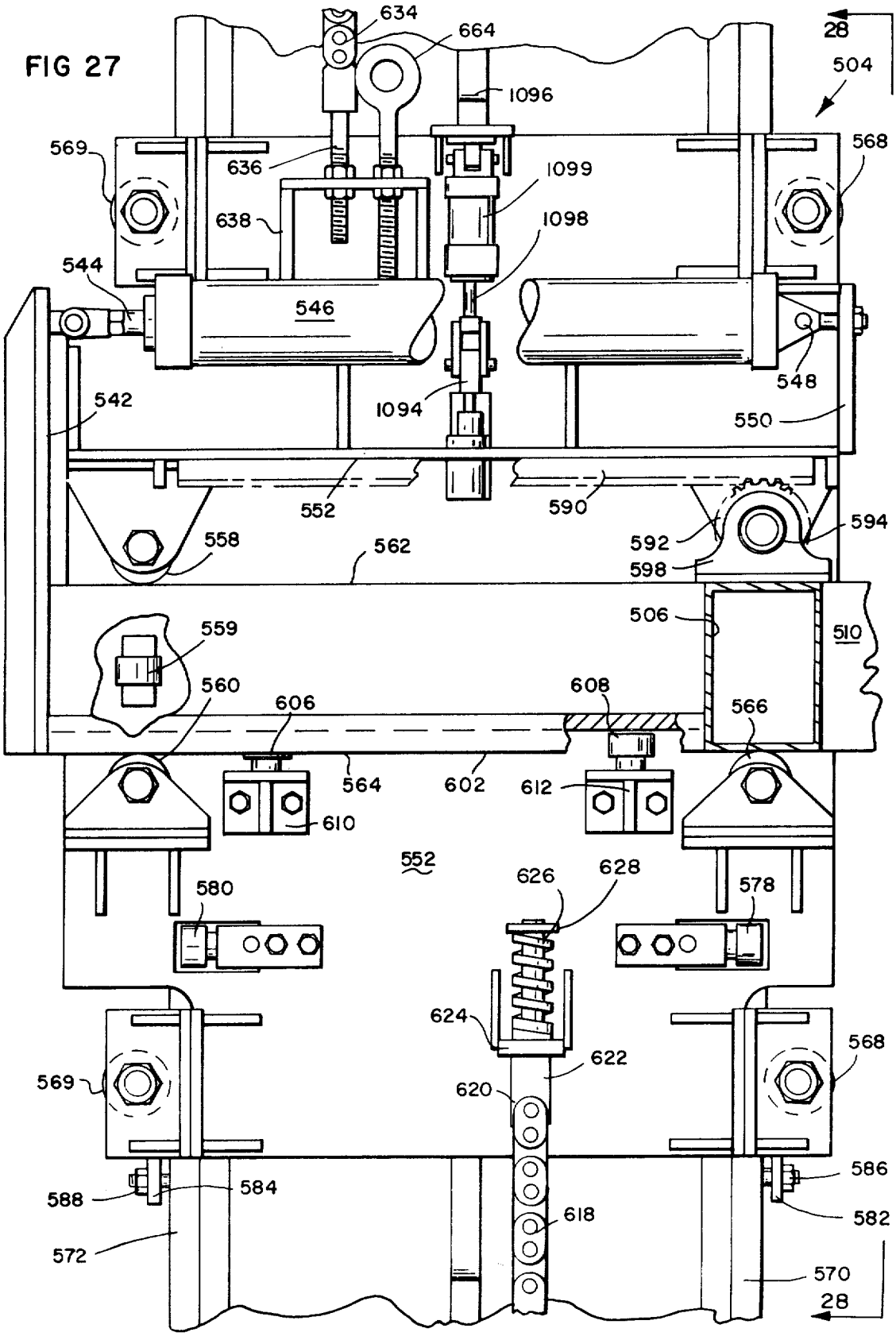
FIG. 27 is a fragmentary, sectional view along line 27—27 of FIG. 26.
Figure 28:
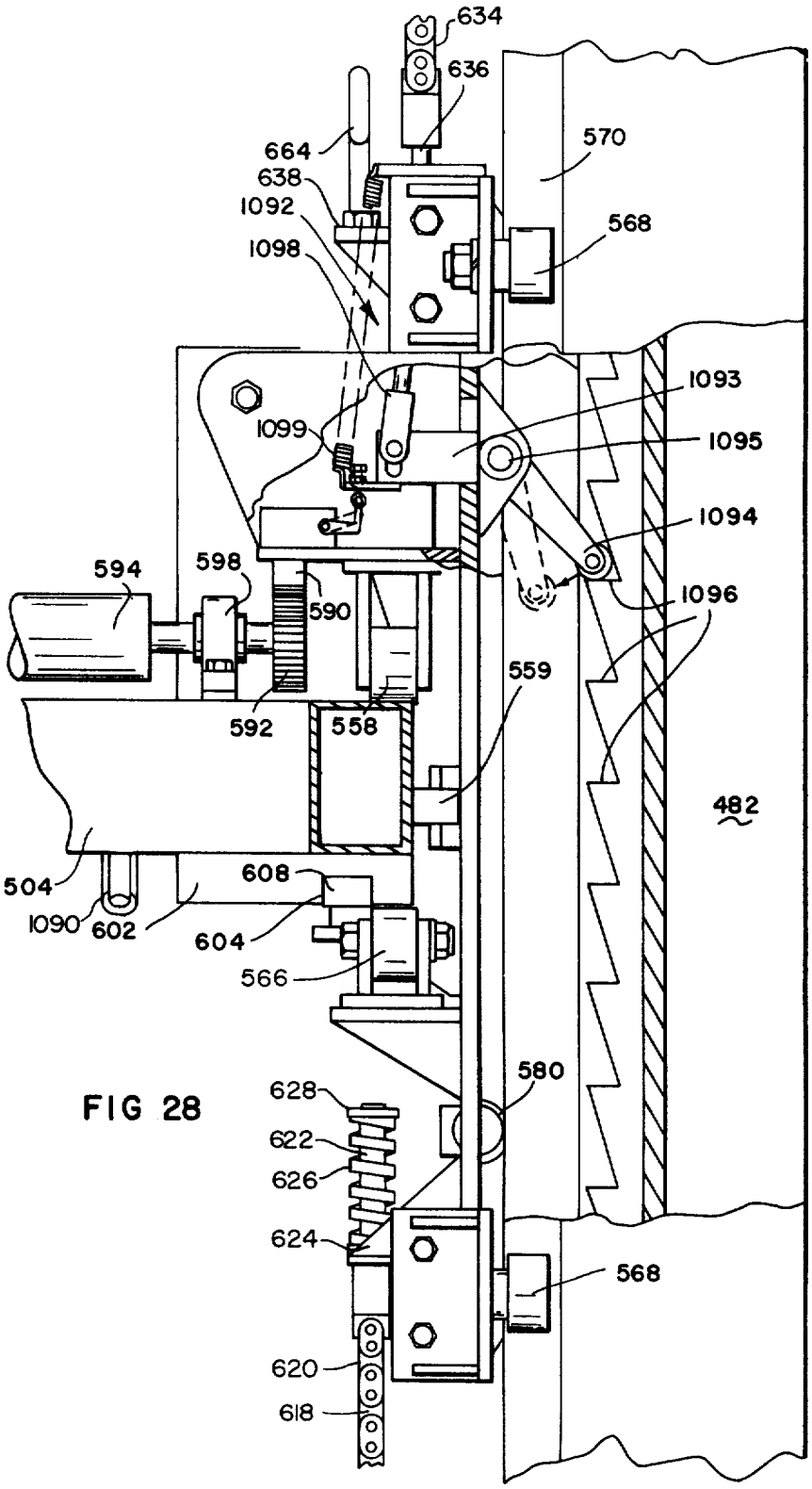
FIG. 28 is a fragmentary, elevational view along line 28—28 of FIG. 27, showing portions broken away and in sections and showing varying positions of parts by broken lines.

Reference is now made to FIGS. 26, 27 and 28 for the specific details which permit movement of the transfer carriage 478 to transverse vertically up and down the vertical frame members 480 and 482 and to move horizontally relative thereto and laterally with respect to the makeup station 59. The end frame members 510 and 512 extend substantially beyond the longitudinal frame member 506 (FIGS. 24, 26). The end of the member 510 is provided with a bracket 542 to which the plunger 544 of a hydralic cylinder 546 is connected. The other end of the hydraulic cylinder 546 is pivotally connected at 548 to a bracket 550 which is coupled to a carriage 552 which is mounted for vertical movement on the vertical frame member 482. An identical arrangement of cylinder and carriage is provided at the other end of the frame 504 so only is described.

Actuation of the hydraulic cylinder 546 and its counter part at the other end of the frame acts to move the frame 504 from a position over the makeup station 59 to a position over the wall panel being assembled. In order to accomplish the movement, the frame member 510, as shown, bears against a roller 559 which is arranged with its axis of rotation vertical and which is mounted on carriage 552. The carriage 552 includes a pair of rollers 558 and 560 which are adapted to engage and horizontally guide upper and lower edges 562 and 564 of the frame member 510 (FIG. 27). Another roller 566 is supported on the carriage 552 and bears against the lower side 564 of the frame member 510 in order to support it in cantilevered relationship for carrying the frame member 508 as well as the frame member 506 and all of the connected mechanism hereinbefore described in connection with FIGS. 24 and 25 of the drawings.

The carriage 552 is adapted for vertical movement along the members 480 and 482. To this end it is provided with axially horizontal rollers 568 and 569 which are engaged on tracks 570 and 572 respectively on opposite sides of the vertical frame member 482 to guide the carriage 552 for vertical movement. As illustrated, a pair of the rollers 568 are in vertically spaced-apart engagement with the track 570 as are a pair of the spaced-apart rollers 569 on the track 572. Additionally, to aid in controlling the movement of the carriage 552, it is provided with a pair of track following rollers 574 and 576 engaging the outside of tracks 570 and 572 respectively at right angles with respect to the rollers 568 and 569 as well as a pair of opposed track following rollers 578 and 580 which ride on the inner side of tracks 570 and 572 (FIGS. 26–28).

The manner of supporting the carriage 552 permits it to move in an up and down rectilinear path along the vertical frame member 482 and, as pointed out, a similar carriage (not shown in detail) supports the opposite end of the frame 504 on the vertical frame member 480 which similarly moves up and down on that vertical frame member. Thus, opposite ends of the course transfer carriage 468 are supported to move vertically and horizontally with respect to the makeup station 59 and the vertical frame members 480 and 482.

The carriage 552 and its counter part at the opposite end each include a gear rack 590 engaged by a spur gear 592 fixed to one end of a torque shaft 594. The torque shaft 594 extends the length of the frame 504 and is supported for rotation in bearings 598, 600 in the frame 504. The torque shaft 594 has another spur gear 592' fixed to its opposite end which meshes with another gear rack 590 similar to the gear rack 590 on the carriage 552. Thus, the torque shaft 594 insures uniform lateral movement of the course transfer frame 504 at each end when moved by the cylinder 546 and the similar cylinder 546 adjacent to the frame member 480.

In order to prevent the course transfer frame 504 from moving longitudinally between the upright frame members 480 and 482, the frame member 510 at its lower side is provided with a track 602 forming the lower edge 564 of the frame member 510 which is engaged by the rollers 560 and 566. This track is provided with a longitudinal recessed channel track portion 604 in which axially vertical rollers 606 and 608 traverse; these rollers 606 and 608 are secured by brackets 610 and 612 on the carriage 552 (FIGS. 27 and 28). Similarly, the counter part of member 510, the frame member 512 is provided with similar rollers and guides.

Figure 29:
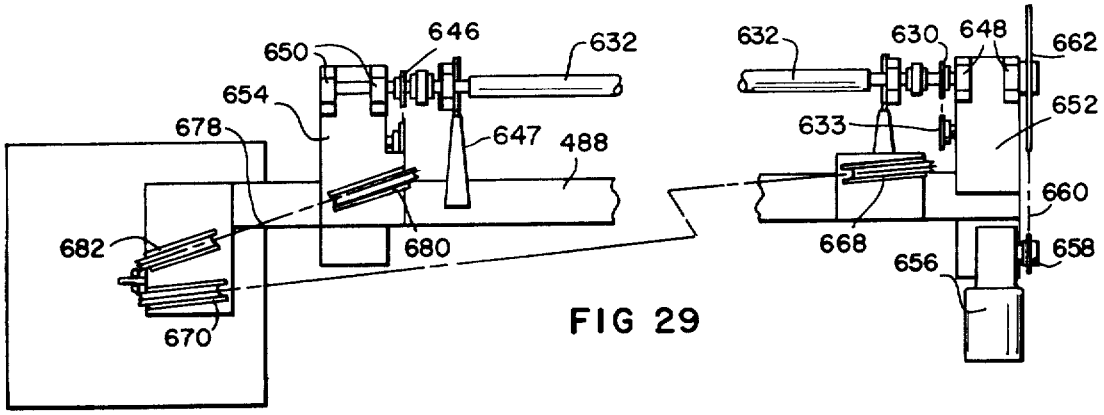
FIG. 29 is a fragmentary, plan view along line 29—29 of FIG. 1.
Figure 30:
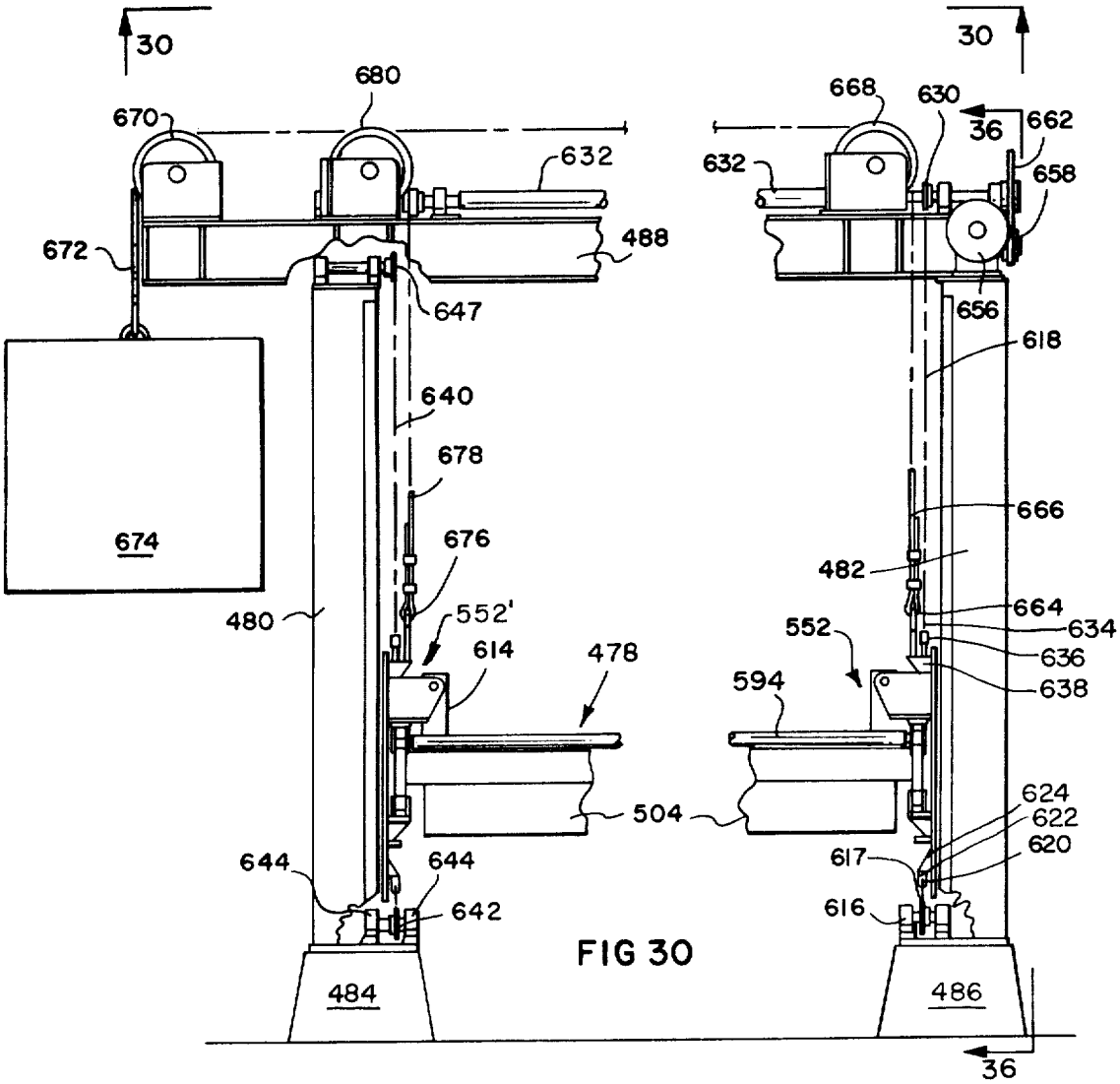
FIG. 30 is a fragmentary, side elevational view along line 30—30 of FIG. 29.
Figure 36:
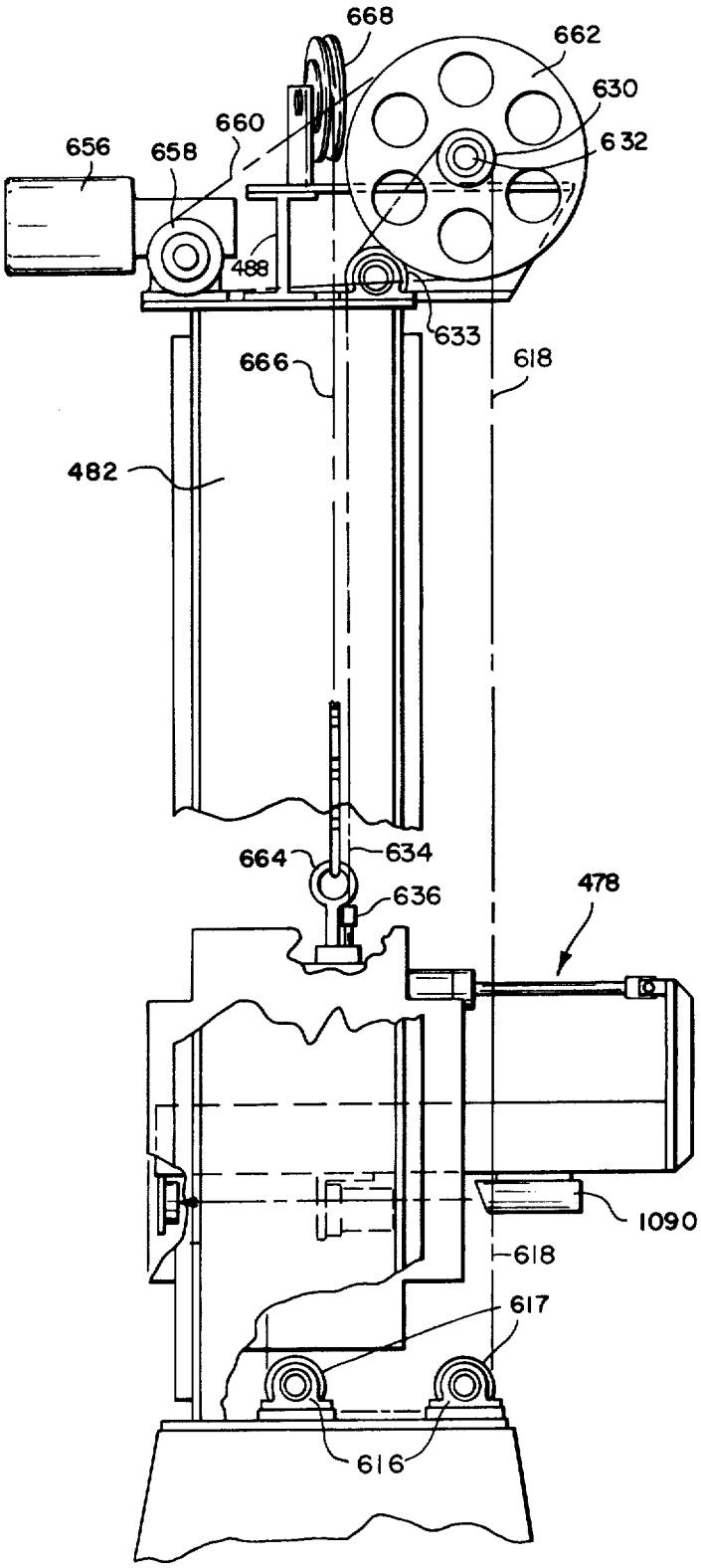
FIG. 36 is a fragmentary, side, elevational view along line 36—36 of FIG. 30.

Referring to FIGS. 30 and 36, rotatably mounted in sets of bearings 616 on the base of frame member 482 are sprockets 617 over which a roller chain 618 is trained. The chain 618 has one end 620 fixed to a shank 622 reciprocally mounted in a bracket 624 carried by the carriage frame 552. A compression spring 626 is mounted between the bracket 624 and a fixture 628 carried by the end of the shank 622 so that the spring 626 is maintained in compression to hold the chain 618 taut over the sprockets 617, a sprocket 630 carried by a shaft 632, and a sprocket 633 mounted on frame member 488 (FIGS. 29, 30 and 36). The spring 626 maintains the chain 618 under tension and an opposite end 634 of the chain is fixed by means of a bolt 636 to a bracket 638 carried by the carriage frame 552 (FIG. 27). The bolt 636 is screw-threadably adjustable relative to the bracket 638 in order to impose compressive force on the spring 626 for tightening the chain 618 relative to the sprockets 617, 630 and 633.

A carriage frame 552', which is similar to the carriage frame 552, is provided with a chain 640 similar to the chain 618 as described in connection with the carriage frame 552. The chain 640 passes over sprockets 642 rotatably mounted in bearings 644, a sprocket 646 on the shaft 632, and a sprocket 647 mounted on frame member 488 as shown in FIG. 29 of the drawings. Thus, rotation of shaft 632 causes chains 640 and 618 to move in unison to raise the opposite ends of the carriage frame 504 at the same rate. The shaft 632 is mounted in bearings 648 on one end and bearings 650 on the other end. These bearings are attached to the frame member 488 by means of respective brackets 652 and 654 (FIG. 29).

A motor 656 is provided with an output shaft carrying a sprocket 658 driving a chain 660 which passes over a sprocket 662 fixed to the shaft 632. Thus, the motor 656 drives the shaft 632 which, in turn, drives the sprockets 630 and 646 for driving the chains 618 and 640 so as to move the transfer frame 504 upwardly and downwardly relative to the vertical frame members 480 and 482 (FIGS. 29 and 30).

Referring to FIGS. 27–30, it will be seen that an eye bolt 664 screw-threadably secured to the bracket 638 of the carriage 552 is coupled to a cable 666 which passes upwardly and over a pulley 668 and downwardly over a pulley 670, both supported on the frame member 488. The cable 666 at its end opposite from the eye 664 is secured to a cable fixture 672 which, in turn, is fixed to a counter-weight 674 adapted to balance the weight of the course transfer frame 504 and its connected mechanism.

As shown in FIG. 30, an eye bolt 676 is connected to the carriage 552', the counter part of carriage 552, at the other end of the frame 504. Secured to the eye bolt 676 is a cable 678 similar to the cable 666. This cable 678 passes over a pulley 680 carried by the frame member 488. The cable 678 also passes over another pulley 682 shown in FIG. 29 of the drawings, and the opposite end of the cable 678 from the eye bolt 676 is secured to the fixture 672 on the counter-weight 674. Thus, both ends of the carriage from structure 504 are equally counterbalaned.

Before describing the operation of the transfer station 63 in detail, we shall describe the panel assembly station 65 so that the interrelationship between the two mechanisms will be apparent.

Figure 31:
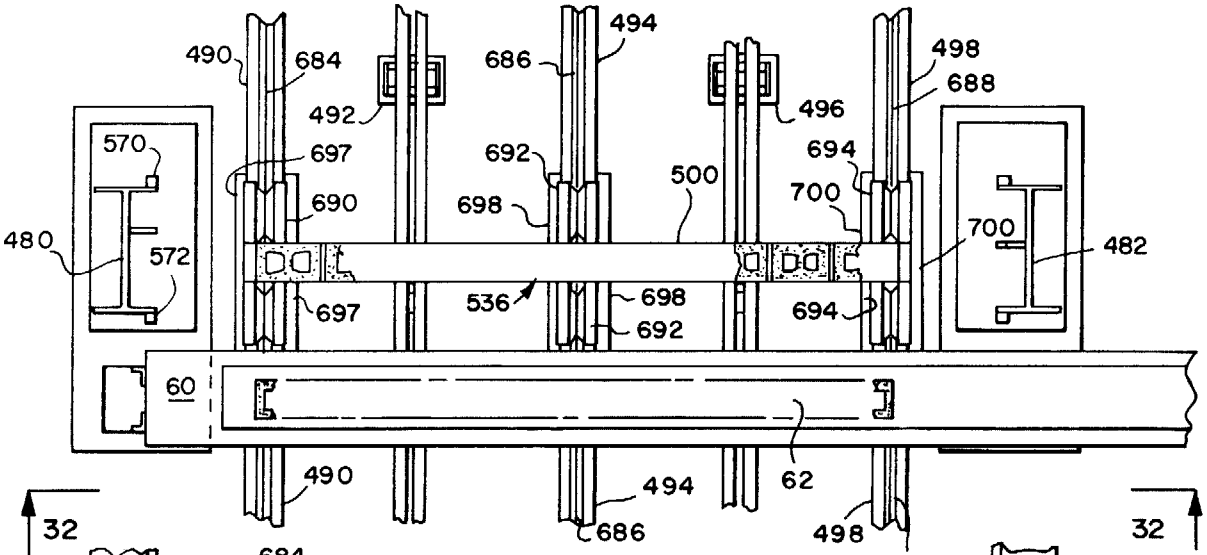
FIG. 31 is an enlarged, fragmentary, plan view along line 31—31 of FIG. 3.
Figure 32:
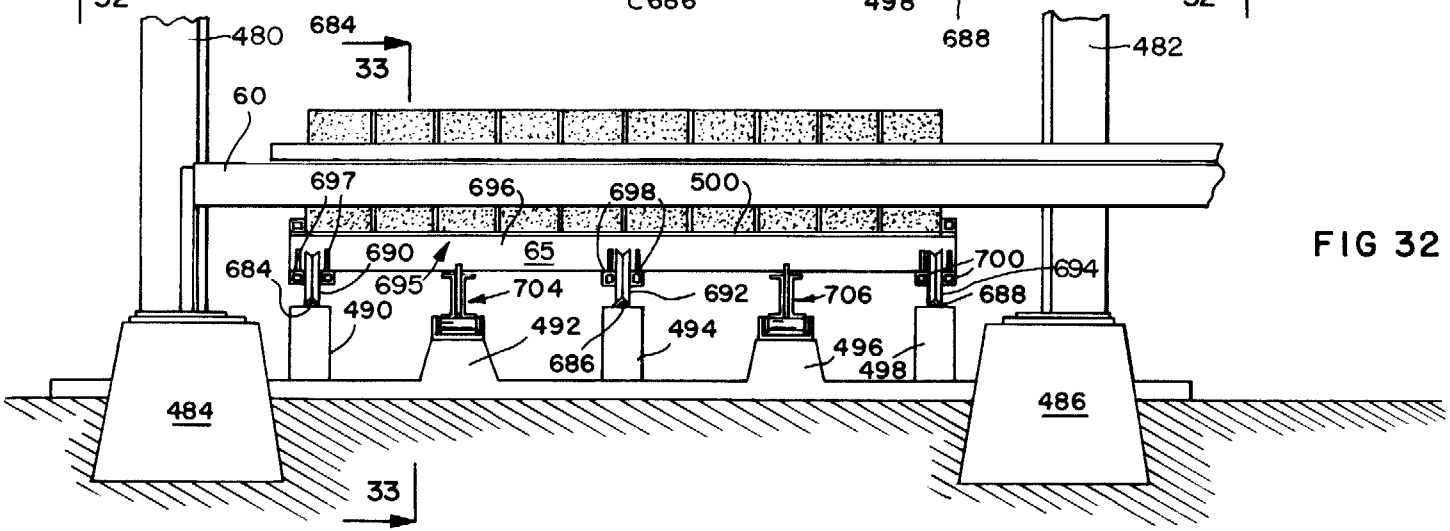
FIG. 32 is a fragmentary, sectional view along line 32—32 of FIG. 31.
Figures 33, 34:
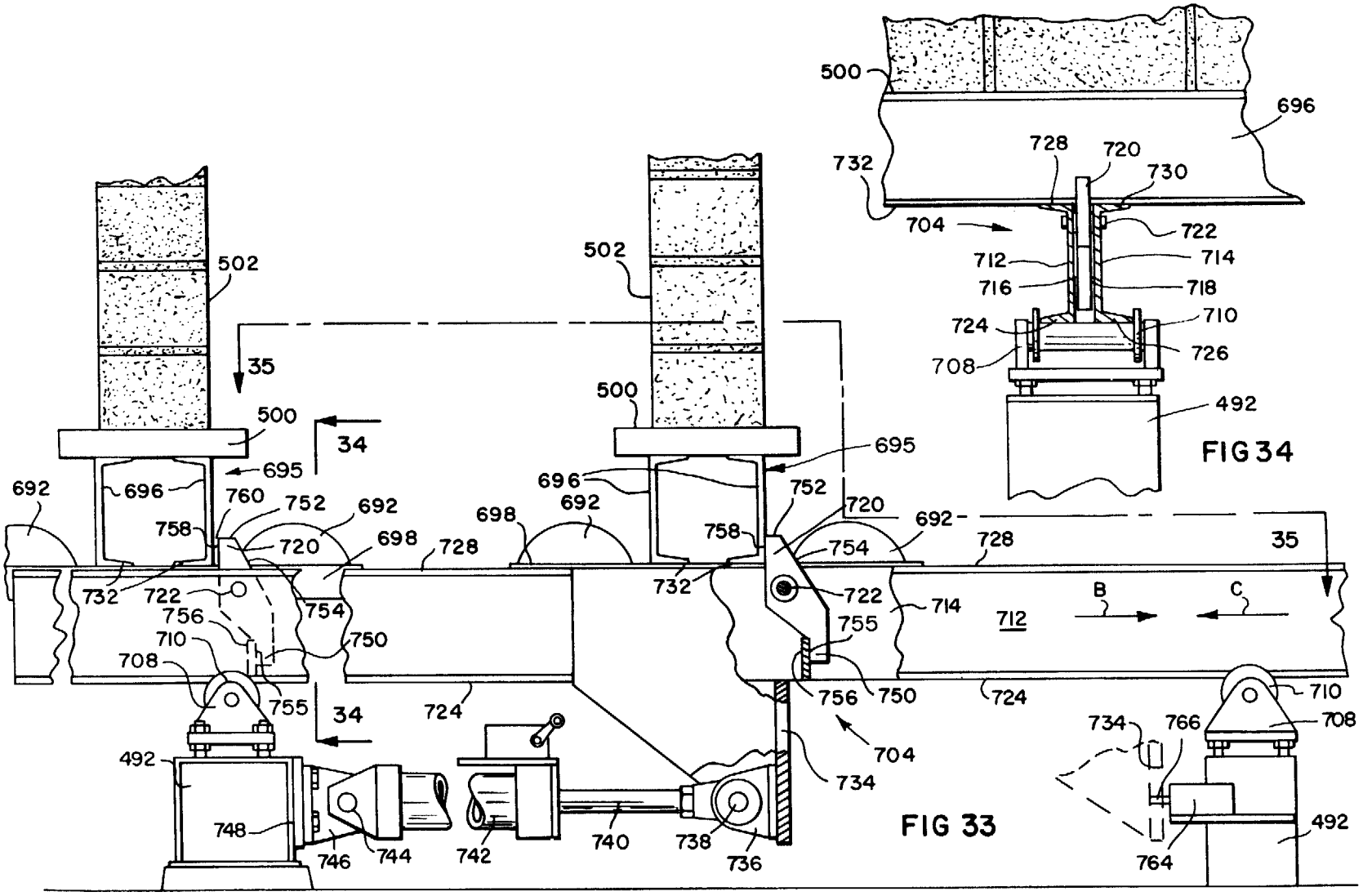
FIG. 33 is an enlarged, fragmentary, sectional view along line 33—33 of FIG. 32.
FIG. 34 is a fragmentary, sectional view along line 34—34 of FIG. 33.

As shown in FIGS. 3, 31, and 32, elongated foundation structures 490, 494 and 498 are provided which support inverted V-shaped tracks 684, 686, and 688 which are traversed by respective pairs of wheels 690, 692, and 694 of pallet-supporting trucks 695. The foundations 490, 494, and 496 and the supported tracks are horizontally disposed and extend at right angles to the table 171 and the longitudinal axis of the transfer carriage 478. As shown in FIGS. 3 and 33 of the drawings, each truck 695 carries a flat pallet 500 upon which a superimposed series of courses of blocks may be mortared together for forming a wall panel. As shown in FIG. 33 of the drawings, each pallet 500 is supported by a pair of elongated channel members 696 and secured to lower portions of these channel members 696 are bars 696, 698, and 700 on which pairs of wheels 690, 692, and 694 are respectively mounted. The pairs of wheels 690, 692 and 694 are all provided with V-shaped grooves in their peripheries and the pairs are spaced far enough apart to lend lateral stability to the truck structures formed thereby for supporting the pallets 500 and panels 502 thereon.

Foundation members 492 and 496 which are spaced intermediate the foundation members 490, 494 and 498, support ratchet mechanisms 704 and 706. These mechanisms are similar and therefore only the details of the ratchet mechanism 704 will be described.

The foundation structure 492 supports roller brackets 708 which carry a series of spool-type rollers 710 as shown in FIG. 34 of the drawings. These rollers 710 support a pair of channels 712 and 714 secured together in back-to-back relationship with each other and being spaced apart at their respective sides 716 and 718 so as to permit the pivotal mounting a plurality of spaced ratchet pawl members 720 therebetween. The ratchet pawl members 720 are pivotally mounted on pins 722 which extend through the channel members 712 and 714. The channel members at their lower respective legs 724 and 726 traverse the rollers, and the channels at their upper edges 728 and 730 slide with clearance transversely below the respective lower edges 732 of the channels 696 of the pallet-supporting carriages which support the pallets 500 as shown best in FIGS. 33 and 34 so that the channel members 712 and 714 may be reciprocated freely back and forth transversely under the channel members 696 and the respective pallets 500.

Secured to the channel members 712 and 714 is a bracket 734 as shown in FIG. 33 of the drawings. This bracket 734 is provided with a clevis portion 736 carying a pin 738 pivotally connecting a plunger 740 of a hydraulic cylinder 742 with the bracket 734. The hydraulic cylinder 742 is pivotally mounted on a pin 744 carried by bracket 746 which is secured to a steel cap 748 on one of the concrete foundation structures 492.

The ratchet pawl members 720 are provided with lower ends 750 which are relatively heavy as compared to their upper ends 752 so that these ratchet members 720 tend to remain in the solid line position shown in FIG. 33.

The ratchet pawl members 720 are provided with inclined cam portions 754 adapted to move under the respective channel members 696 at the lower edges 732 when the channel members 712 and 714 are moved in a direction of the arrow B (FIG. 33). The channel members 712 and 714 are movable in the direction of arrow B by means of the hydraulic cylinder plunger 740 when it is extended from the cylinder 742.

Likewise, when the cylinder plunger 740 is retracted into the cylinder 742, the channel members 712 and 714 are moved in the direction of the arrow C.

As shown in FIG. 33 of the drawings, each ratchet pawl member 720 is provided with an abutment portion 755 which abuts a stop member 756 carried between the channel members 712 and 714. Additionally, each ratchet pawl member 720 is provided with a pawl portion 758 which engages one side of one of the channel members 696 of each pallet supporting truck so that when the plunger 740 of the hydraulic cylinder 742 is retracted in the direction of the arrow C, each pawl engages a respective pallet carriage and moves it in a direction of the arrow C in FIG. 33 of the drawings, which corresponds with the direction of an arrow C in FIG. 31 of the drawings. It will be seen that the pawl surfaces 758 of the several ratchet members 720 are progressively spaced so that as they are retracted in the direction of the arrow C for moving the pallets 500, the ratchet members 720 will engage respective panel-supporting trucks serially at their pawl surfaces 758. As an example, FIG. 33 discloses two of the pawl surfaces 758 and one of them is slightly spaced at 760 from the respective channel 696 which supports the pallet 500. There may be a number of the pallet-supporting trucks and, therefore, the spacing, as shown at 760, insures that all of the laden pallet trucks are not engaged at one time but instead are engaged serially.

Each time it is desired to advance an unladen pallet 500 onto position for receiving successive courses of blocks from the makeup table, the hydraulic cylinder plunger 740 is cycled in order to move the channels 712 and 714 and the ratchet pawl members 720 relative to the pallet-supporting trucks and to engage and advance them a distance substantially equal to slightly more than the width of the trucks such as shown in FIG. 3 wherein the rollers 694 may be operated in substantially close proximity to each other as desired.

Figure 35:
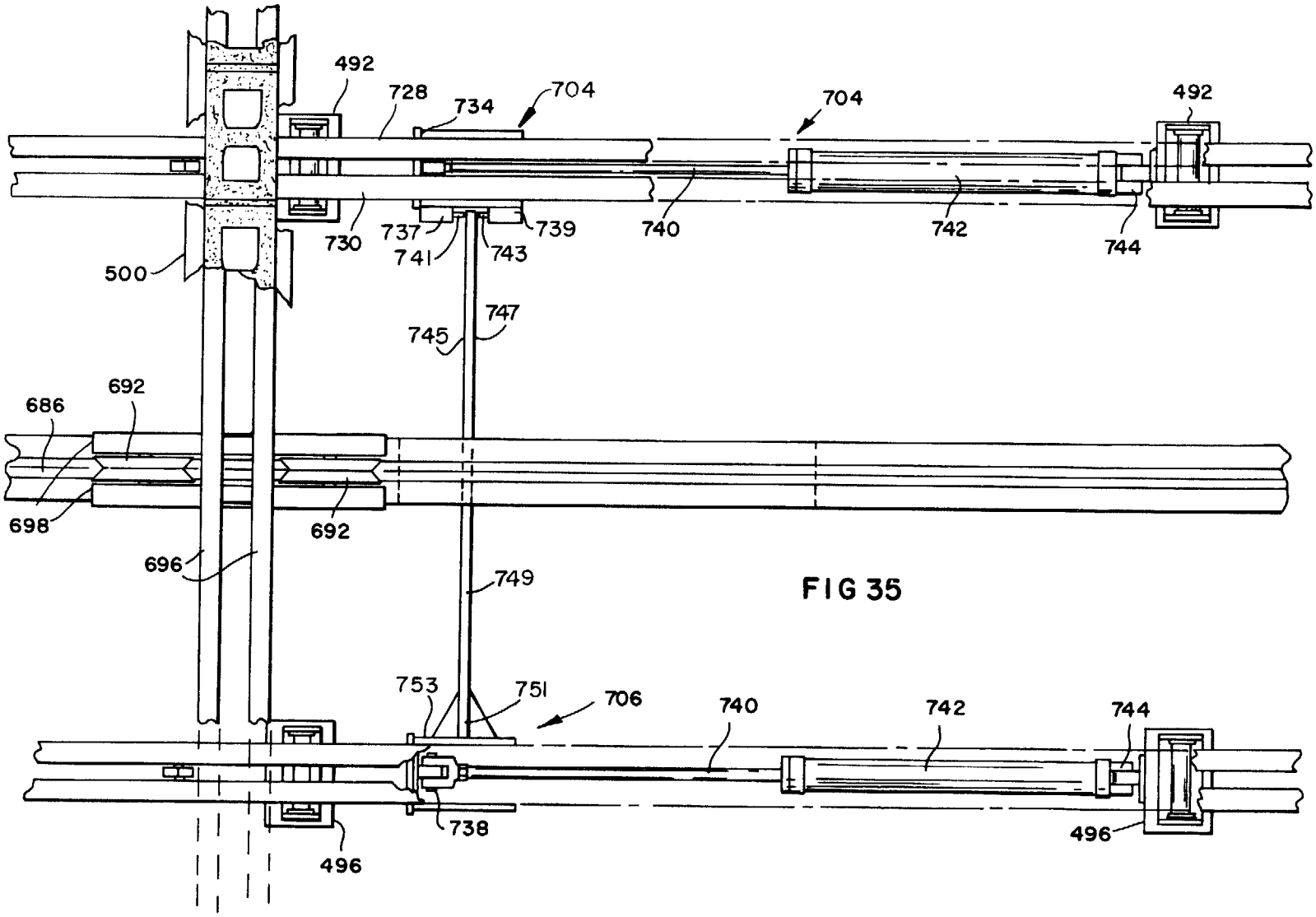
FIG. 35 is a fragmentary, sectional, plan view along line 35—35 of FIG. 33.

As shown in FIG. 35 of the drawings, and as indicated in FIG. 32 of the drawings, there are a pair of the cylinders 742 with their respective plungers 740 and since these cylinders are spaced laterally apart it is necessary to co-ordinate longitudinal extension and retraction of the plungers 740 in order to maintain the uniform movement of the trucks supporting the pallets 500 along the tracks 684, 686, and 688.

To this end, the stroke of the plunger 740 of each cylinder 742 is controlled by a limit switch 764 having a switch arm 766 engaged by a surface of the bracket 734 coupled to the channels 712 and 714 (FIG. 33).

Also, shown in FIG. 35, the bracket 734 carries a pair of limit switches 737 and 739 having switch arms 741 and 743. These plungers are spaced apart and are disposed at opposite sides 745 and 747 of a control bar 749 which is fixed at its one end 751 to a bracket 753 similar to the bracket 734. It will be seen that the bracket 753 is part of the ratchet mechanism 706 and bracket 734 is part of the ratchet mechanism 704 (FIG. 32). When the hydraulic cylinders 742 of the ratchet mechanisms 704 and 706 are energized, the bar 749 carried by the bracket 753 advances along with the arms 741 and 743 of the limit switches 737 and 739.

In the event the plunger 740 of the cylinder 742 of the ratchet mechanism 706 is retracted too fast with respect to the ratchet mechanism 704, the side 747 of the bar 749 engages the arm 743 of the limit switch 739, thereby actuating circuitry which effect momentary reduction of the flow of hydraulic fluid to the cylinder 742 of ratchet mechanism 706 to reestablish unison of movement of the plungers of the respective ratchet mechanisms. In the event the plunger 740 of the cylinder 742 of the ratchet mechanism 704 advances too rapidly upon retraction of the plunger 740, the side 745 of the bar 749 is contacted by the arm 741 of the limit switch 737, thereby reducing fluid delivery to that cylinder and thereby equalizing operation of the two cylinders 742 of the respective ratchet mechanisms 704 and 706 so that each pallet 500 is retracted uniformly along the tracks 684, 686, and 688.

The transfer mechanism 63 operates in the following manner. After a course of the desired length is formed on the table 171, the transfer carriage 478, which, in its rest position, is maintained at the top of its line of travel on the vertical structural members 480 and 482, is shifted laterally so that it lies over the course supported on the table 171. This is accomplished by the hydraulic cylinder arrangement 546 in the manner which has been described. Thereupon, the carriage 478 is lowered until it fits over the course of blocks to be moved (FIG. 25), At that point, the clamping mechanism 173 on the table 171 is released to free the course and the hydraulic cylinders 529 on the transfer carriage are energized to rigidly clamp the course as a unit between the bolts 522, 524 and the plunger tips 532 on the hydraulic cylinders. The motor 656 is then operated to raise the transfer carriage to its uppermost position through the action of the roller chains 640 and 618. When the carriage 478 reaches its uppermost position, it is shifted laterally by means of the hydraulic cylinders 546 to bring the course into alignment with a pallet 500 which is disposed directly below that position of the transfer carriage. The motor 656 is then actuated to lower the transfer carriage 478 together with the clamped course to place the course on the pallet 500 or upon a previous course which has been placed on the pallet.

As has been pointed out, the length of the course is maintained within a multiple of a modular block length plus a nominal mortar joint thickness and means is also provided to maintain the vertical spacing of the courses in a modular relationship. This latter means includes a photocell 1090 as illustrated in FIG. 36. The photocell 1090 operates in conjunction with indexing mechanism 1092 shown in FIG. 28. The index mechanism 1092 includes a number of spaced apart buttresses 1096 which are proportioned to correspond to the vertical modulus of a course of blocks and which are supported on the vertical member 482. The vertical modulus would include the nominal height of a block together with a nominal bed joint thickness.

As the transfer carriage is lowered, the beam of the photocell 1090 is interrupted as it passes over the top edges of the previously laid course of blocks on the pallet 500 at which point the buttress engaging arm 1094 is moved into engagement with the next occurring buttress 1096. The arm is pivoted on a pin 1095 on the carriage 478 and its movement is controlled by means of a solenoid actuated link 1098 which is connected to a crank arm 1093 on the pin 1095 (the solenoid, not shown, is actuated by the photocell 1090). The buttress engaging arm 1094 moves into the solid line position shown in FIG. 28 of the drawings and causes downward movement of the carriage to be stopped at a precise elevation. By means of this indexing means any imperfections in the height of the course are taken into account and are absorbed in the bed joint. In order that both ends of the transfer carriage are maintained at the same height, the vertical frame support 480 at the other end of the carriage is desirably provided with a similar indexing mechanism including a set of buttresses and solenoid operated indexing arm.

In order to insure that the top course of blocks is properly seated in the bed mortar, a vibrating means 531 is provided as illustrated in FIGS. 24 and 25. The vibrating means 531 includes a series of channels 533 which are supported in longitudinal alignment by chains 535 from the cross supports 538 on the transfer carriage frame 504. Each of the channel members 533 supports a pair of conventional vibrating mechanisms 537 which are actuated after the course is seated at the proper height by the indexing means 1092 so that the top course is vibrated into the bed mortar of the next preceding course. In this connection, the chains 535 are long enough so that the channel webs 533*a* which are downwardly directed will rest on the upper surface of the course of blocks. When the vibration is completed, two narrow grooves are left in the bed mortar, but it has been found that this does not affect the bed joint.

After the desired period of vibration, the vibrators are de-energized, the clamping cylinders 529 are released, the transfer carriage is moved by the motor 656 to its uppermost position to repeat the cycle, and incident therto a spring 1099 returns the arm 1094 to the dotted line position (FIG. 28).

It has been found that block panels made in the manner described above may be manufactured at a rapid rate with a minimum of labor. Moreover, the resulting panels after curing have greatly enhanced strength as compared to panels which are laid manually by masons. Furthermore, the panels may be made to predetermined modular distances both longitudinally and vertically within a tolerance which is equal to the tolerances of a single block. This makes possible the assembly of the panels in modular building construction with a minimum of inconvenience.

As shown in FIG. 3 the panels 502*a–d* which have been completed are stored on the pallets 500 after they are made on a section of track beyond the position at which a panel is assembled. Normally, the panels are permitted to rest on the pallets to cure for twelve hours after which they may be handled as a unit by conventional material handling equipment, e. g. a crane or a lift truck. In the event that it is desired to accelerate the curing process, a steam curing chamber 762 may be provided as indicated in outline on FIG. 3.

Figure 37:
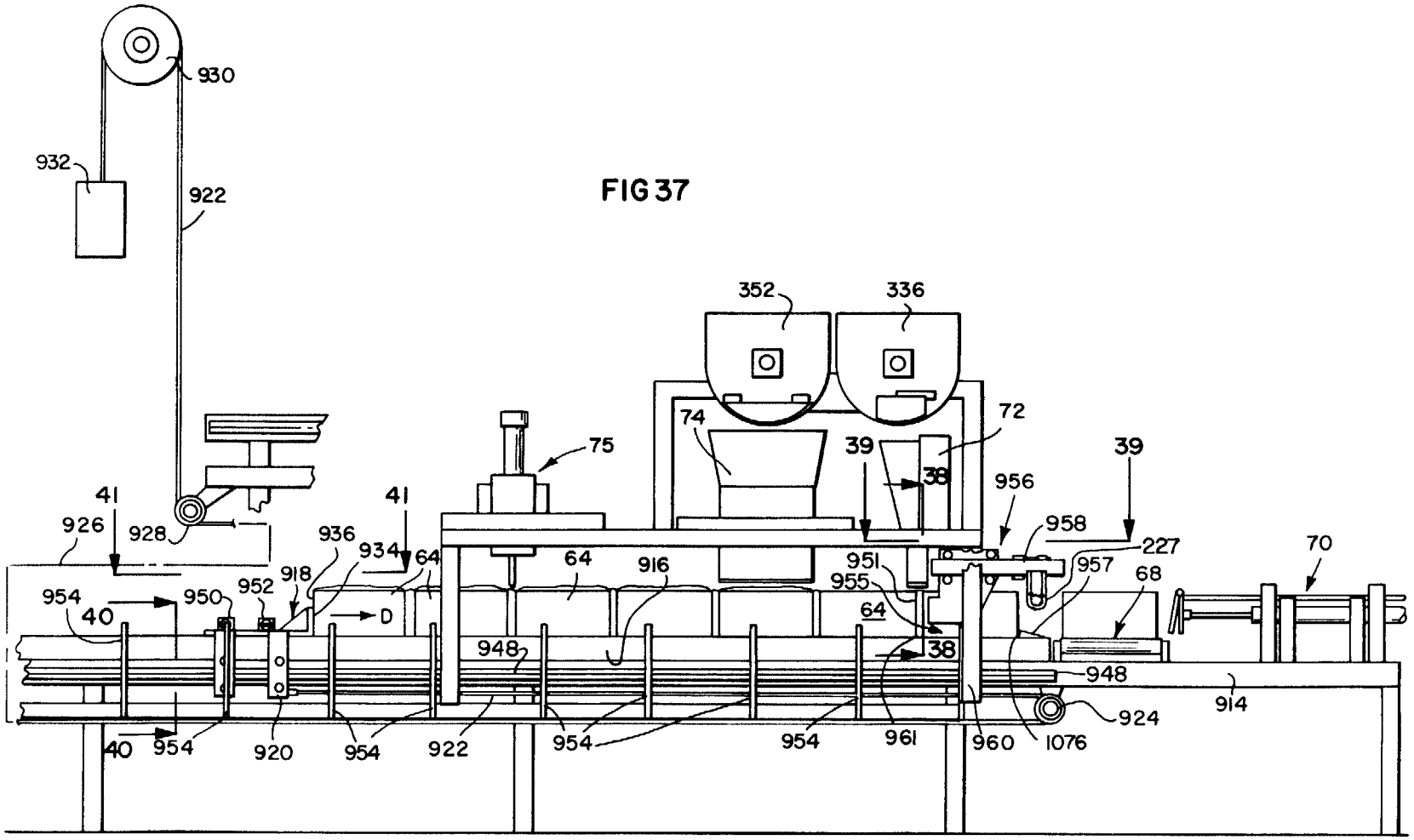
FIG. 37 is a fragmentary, side elevational view of another embodiment wherein a course of blocks is advanced by forcibly sliding the entire course longitudinally together with mortar head joints and bed joints.

In FIG. 37 there is illustrated another embodiment of mechanism to advance the blocks a modular distance. The modification includes a frame 914 similar to the frame 60 hereinbefore described and is provided with a receiving area 68, and a pusher mechanism 70. The modification involves the provision of a stationary makeup table 916 in place of the reciprocating table 171 which has been described.

In order to control the length of the course, a sensing means is provided to sense the position of the forward face of the leading block. Movable along the makeup table 916 is a sensing cart 918 having a downwardly depending frame portion 920 to which a cable 922 is connected. The cable 922 extends over a pulley 924 rotatably supported on the frame 914 and extends, as indicated diagrammatically by broken lines 926, to a pulley 928 at the end of the frame 914 and then upwardly and over an elevated pulley 930 at which point the cable 922 is coupled to a weight 932. The weight and cable arrangement biases the cart in the direction of the arrow D (FIG. 37) so as to hold a face plate 934 of the cart against the leading end 936 of a concrete block 64 which is the first of a course being accumulated longitudinally along the makeup table 916.

Figure 40:
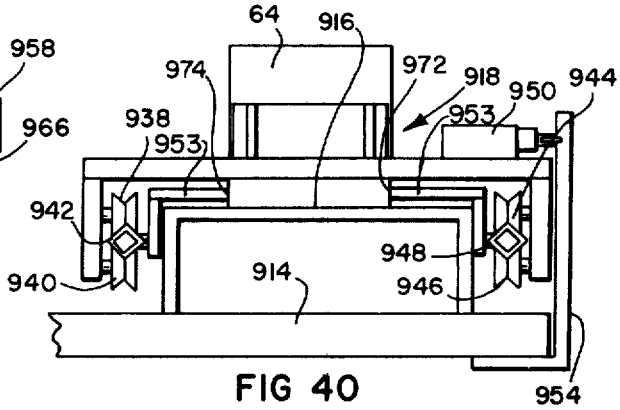
FIG. 40 is an enlarged, fragmentary, sectional view along line 40—40 of FIG. 37.

The cart 918 (FIG. 40) is provided with a pair of opposed sets of rollers 938 and 940 rotatably engaged against opposite sides of a rail 942 secured to the frame 914. The opposite side of the cart 918 is provided with a similar pair of opposed rollers 944 and 946 which engage a rail 948 carried by the frame 914. The peripheries of the rollers 938, 940, 944 and 946 are V-grooved and the rails 942 and 948 are made of rectangular tubing so that the rollers on the rails locate the cart both vertically and horizontally as it moves longitudinally along the frame 914 and over the upper surface of the makeup table 916.

Figure 41:
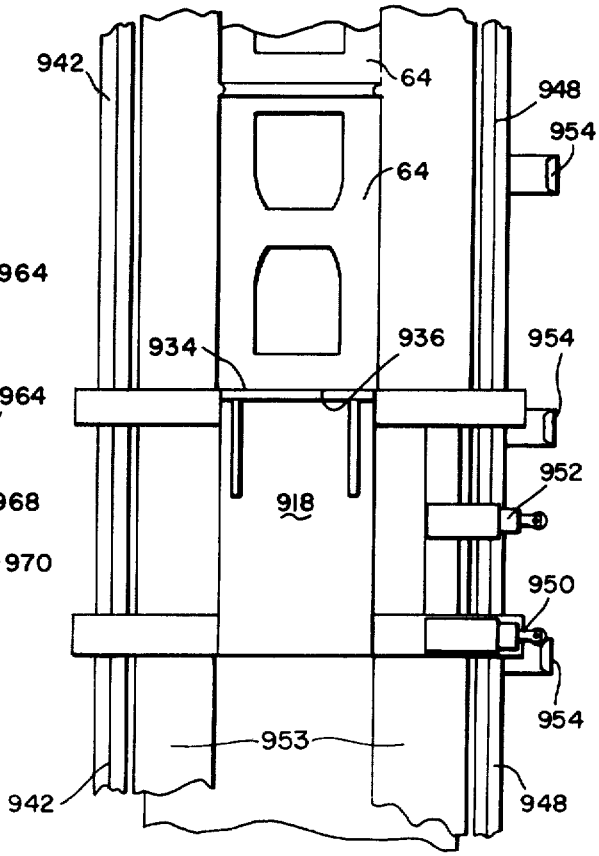
FIG. 41 is an enlarged, fragmentary, plan view along line 41—41 of FIG. 37.

The cart 918 carries a pair of switches 950 and 952 which are operably engageable with longitudinally spaced apart upstanding posts 954 (FIGS. 37 and 41). The switches 950 and 952 are provided with roller contact arms which are engageable with the posts 954 and the posts 954 are spaced apart along the table 916 a distance equal to a modular length of a concrete block and its head joint mortar. The switches 950 and 952 are spaced apart the proper modular distance for a half block so that the switches may be used for switching in accordance with the offset of a half-block in a course.

In the modification shown in FIG. 37, the head joint and bed joint mortar placement mechanisms 72 and and 74 are similar to that hereinbefore described as is the mortar strike mechanism 75.

The embodiment as shown in FIG. 37 includes a pusher mechanism 70 which pushes the blocks as described but continues to push them and slide them forward toward the cart 918 so that an entire course of blocks is slidably moved on the makeup table 916 with the head joint mortar in compression, thereby forcing the entire course longitudinally along the makeup table by means of the pusher mechanism 70. In order to keep the blocks in alignment, guide plates 953 having guiding edges 972 and 974 which are in close proximity to the sides of the blocks extend the length of the table 916.

With this mechanism, a space-back device, generally indicated at 956, is operable to space one block backward preliminarily to each operation of the head joint mortar mechanism 72 to place a head joint between adjacent ends of the concrete blocks 64. As shown in FIG. 37, one of the blocks 64 at its end 951 is in a location to receive head joint mortar and another block 64 at its end 955 is spaced backwardly in a direction toward the pusher mechanism 70, so as to provide a space between the ends 951 and 955 for the placement of mortar head joint by the mortar head joint placement mechanism 72. This is necessary since, as will be described, the pusher mechanism 70 slides the entire course of blocks 64 longitudinally along the makeup table 916 each time a block is added to the course at the receiving station 68.

Figure 38:
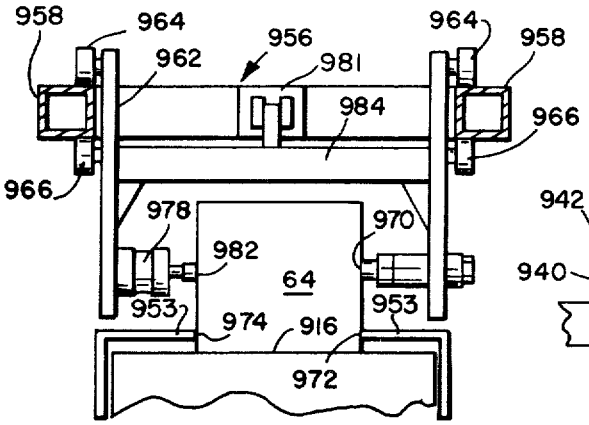
FIG. 38 is an enlarged, fragmentary, sectional view along line 38—38 of FIG. 37.
Figure 39:
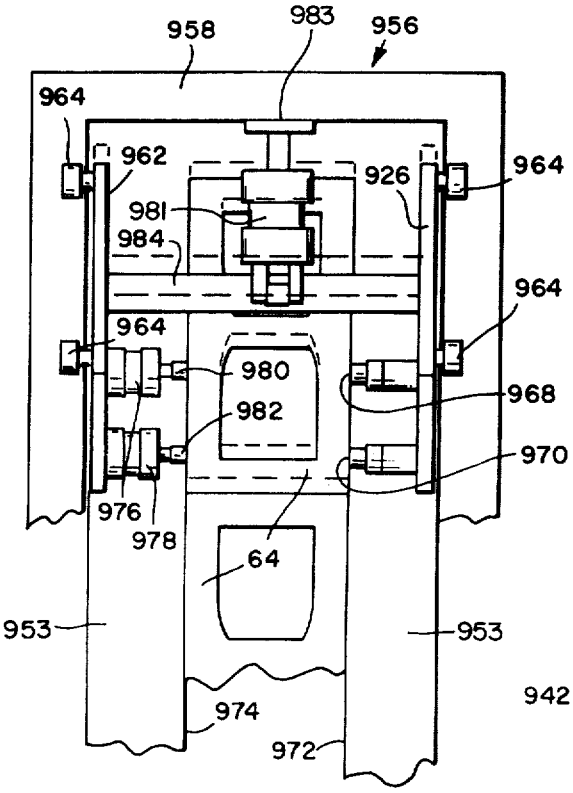
FIG. 39 is a plan view along line 39—39 of FIG. 37.

The space-back mechanism 956 is shown in detail in FIGS. 38 and 39. The mechanism 956 is provided with a generally U-shaped frame 958 which is carried by upstanding frame members 960 carried on the main frame 914.

A clamp carriage 962 is supported on four rollers 964 which ride on the U-shaped frame 958 on its upper side as shown in FIG. 38 and a similar set of opposed rollers 966 traverse the U-shaped frame 958 on its lower side so as to permit the clamp carriage 962 to move longitudinally a distance along the makeup table 916 of approximately a head joint. The clamp carriage 962 is provided with a pair of stationary bolts 968 and 970 on one side for engaging a side of a block 64 in alignment with the edges 972 and 974. The clamp carriage 962 at its other side carries a pair of fluid energizable cylinders 976 and 978 having respective plungers 980 and 982 adapted to engage the side of the block 64 opposite to that engaged by the bolts 968 and 970. Coupling the clamp carriage 962 to the U-shaped frame 958 is a fluid energizable cylinder 981 and an associated plunger 983. The cylinder 981 being coupled to the clamp carriage 962 on a cross member 984 while the plunger 983 is coupled to the outline frame 958.

In operation, the embodiment shown in FIGS. 37–41 involves feeding blocks onto the infeed conveyor 66 to the receiving area 68. The presence of a full block in the receiving area 68 energizes the pushing mechanism 70 and pushes the block in the receiving area forwardly along the table 916 until the course of blocks causes the sensing cart 918 to move sufficiently to cause both of the switches 950 and 952 carried by it to be tripped by one of the posts 954. At that point, the pusher mechanism is actuated to retract the push plate 113. In this position, the course of blocks is of an exact modular length with reference to a post and the trailing edge of the last block 64 on the table 916 has passed over an upwardly biased dog 957 and has moved somewhat forwardly thereof. At this point, the space back device 956 is energized to engage the last block on the table 916 and to move it rearwardly against the dog 957. With the block in this position, the head joint is filled in the manner which has been described and all of the other functions of the machine are operated in manner described. In the event that a half block is required in the course, the action of the electric eye 227, whose beam is not broken during the initial movement of the block and which is indicated by the correlation between the electric eye 227 and the switch 138 on the plate 110, as before indicated, causes the switch 136 to return the push plate to its normal position after only one of the switches 950 or 952 has been tripped by a post 954. At this point, the half block is pulled back against the dog 957 and is in proper position to have its head joint mortared.

By employing the mechanism of the embodiment which has just been described, certain simplications of operation are possible and it has been found that when head joints have been made as previously described employing the vibrating fingers, the mortar in the head joint is suficiently incompressible to permit moving the entire course in the manner indicated. The embodiment just described is operable to make panels meeting the same specifications as those made on the embodiment of FIG. 1.

Figure 42:
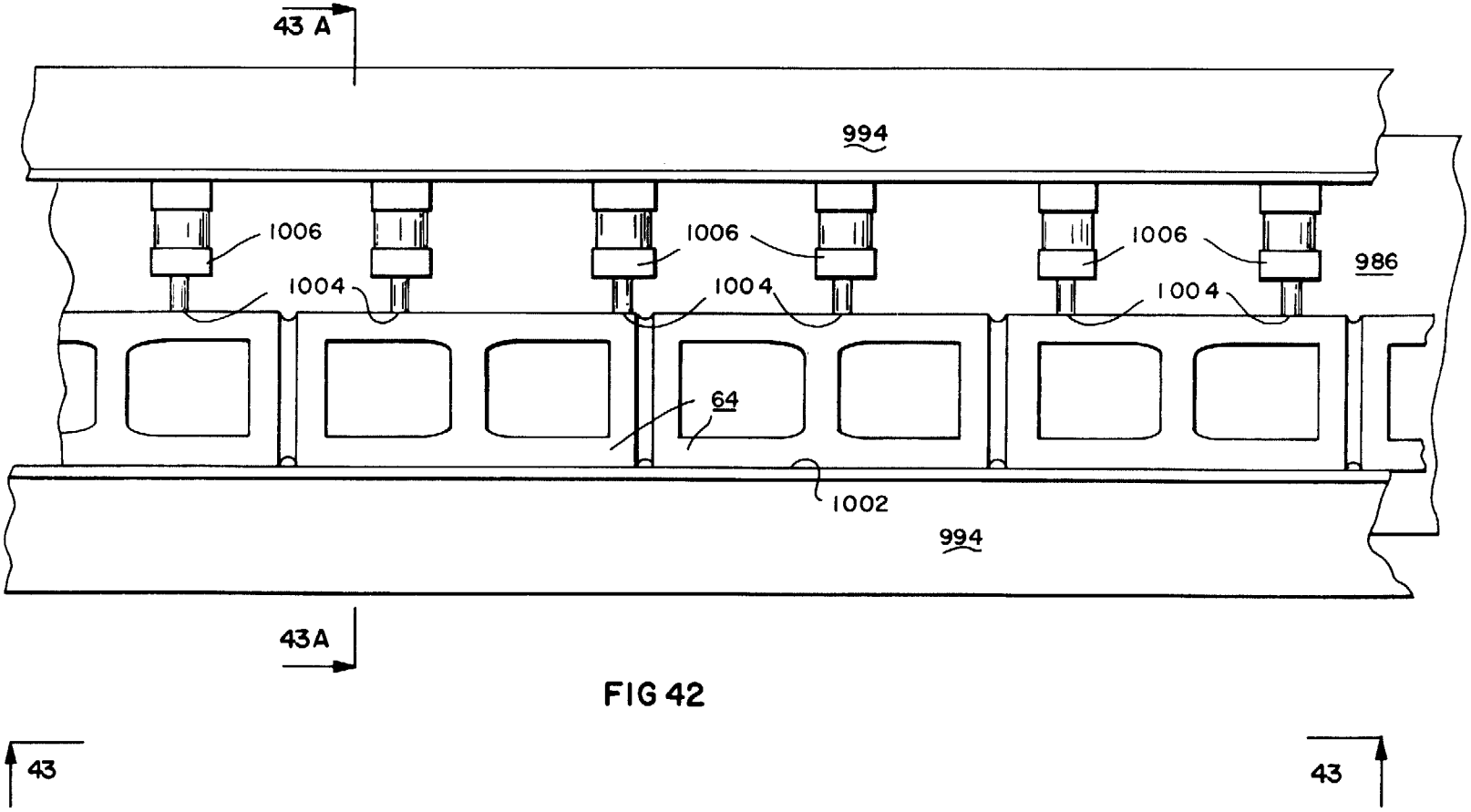
FIG. 42 is a side elevational view of a modified means for moving a course of blocks together with mortar head joints and bed joints as the course is assembled.
Figure 43:
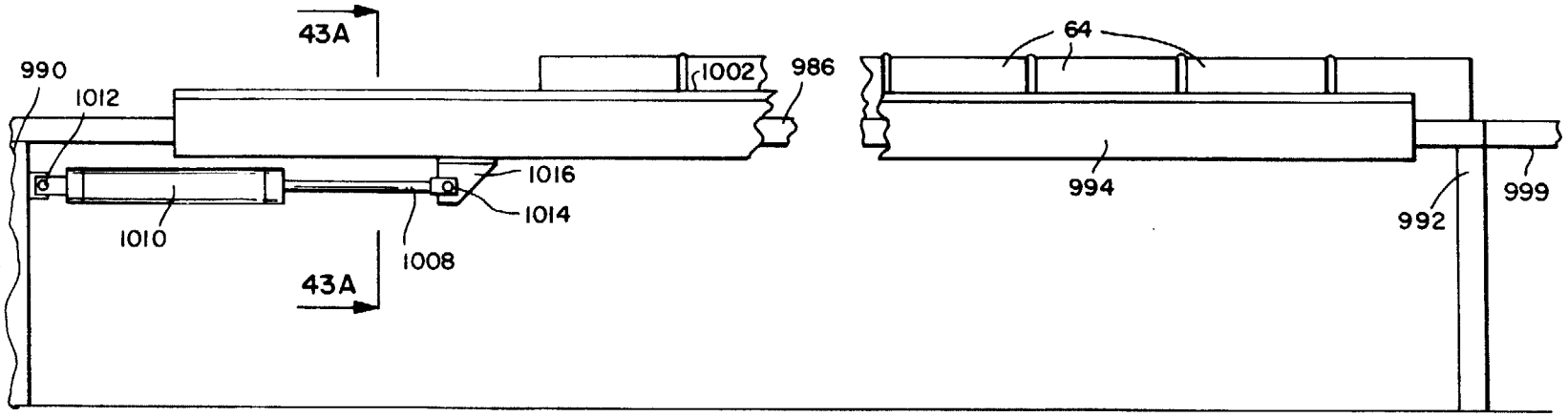
FIG. 43 is a plan view of the structure shown in FIG. 42.
Figure 43A:
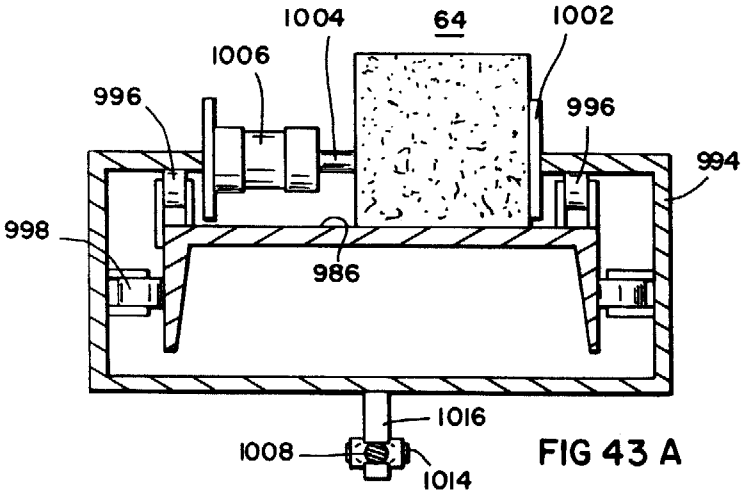
FIG. 43A is a sectional view along lines 43A—43A of FIGS. 42 and 43.

Another embodiment is shown in FIGS. 42, 43 and 43*a*. This embodiment includes another means for sliding a course of blocks longitudinally along a makeup table. As shown in FIGS. 42, 43 and 43*a*, a makeup table 986 is supported in a fixed position on a frame 999 similar to frame 60.

A clamp carriage 994 is movable longitudinally along the makeup table 986 on rollers 996 mounted on the makeup table 986, there being a plurality of these rollers spaced longitudinally along the makeup table 986. Additionally a plurality of vertically axial rollers 998 are mounted on the clamp carriage 994 to bear on one side of the makeup table 986 while a plurality of vertically axial rollers 1000 are carried by the clamp carriage 994 to bear on opposite sides of the makeup table 986 thereby guiding the clamp carriage 994 for movement longitudinally along the makeup table 986. The clamp carriage 994 is provided with an alignment plate 1002 against which one side of a course of blocks is aligned. On the opposite side of the course are plungers 1004 of fluid energizable cylinders 1006 carried by the clamp carriage 994 so that when the blocks 64 are clamped between the plungers 1004 and the alignment plate 1002, the carriage 994 may be actuated by a plunger 1008 of a hydraulic cylinder 1010 mounted on the end 990 of the frame 999. It will be seen that the cylinder 1010 is pivotally mounted on a pin 1012 carried by the end portion 990 of the frame 999 and that the plunger 1008 is pivotally mounted by means of a pin 1014 to a bracket 1016 on the clamp carriage 994. Operative control of the hydraulic cylinder 1010 and its plunger 1008 to compensate for full and half blocks is accomplished in the manner which has been described. In operation, the clamp carriage 994 clamps a course, is moved a modular length for a full or half block and then releases the course and returns to its original position. Blocks may be fed to the inlet end of the table 986 in the manner of the embodiment described in connection with FIG. 1.

Figure 44:
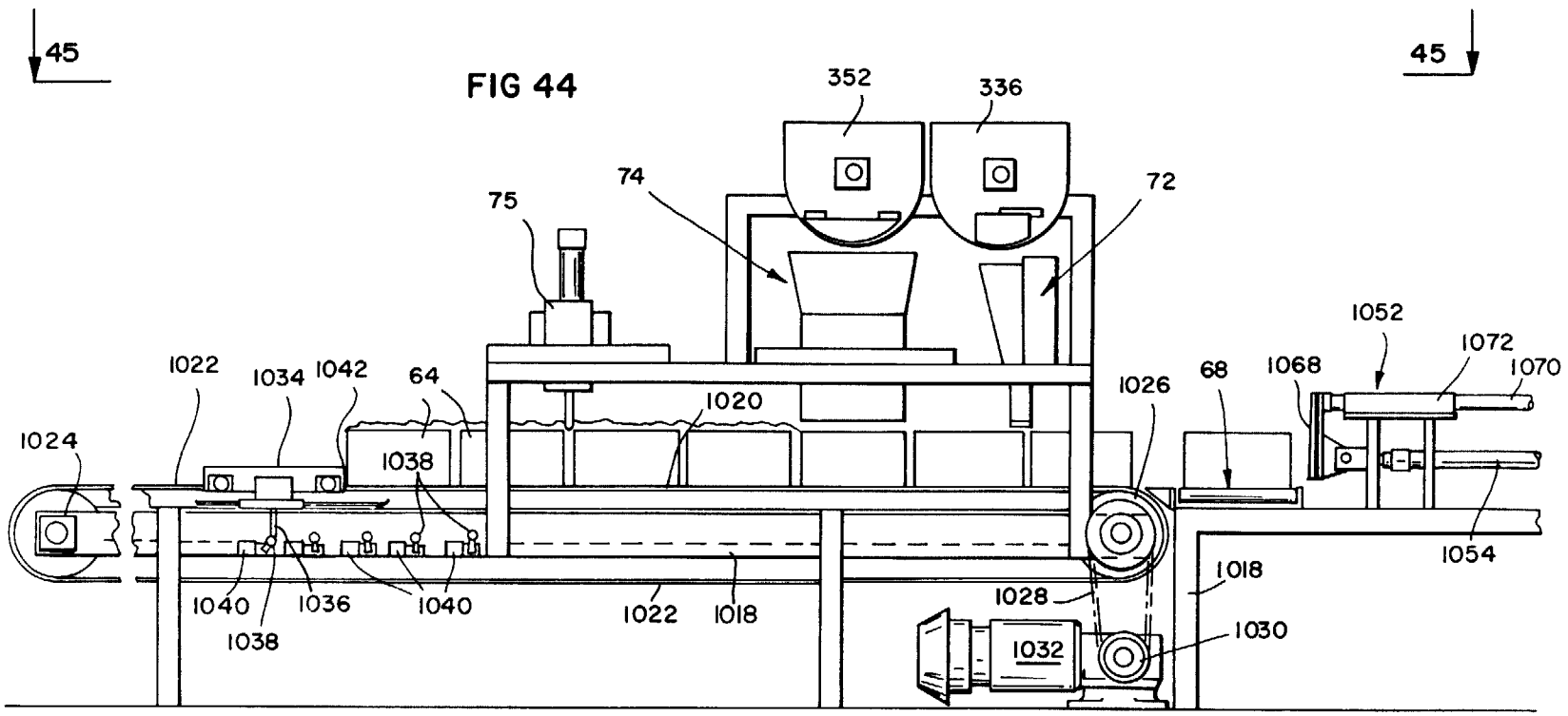
FIG. 44 is a side elevational view of a modified means for moving a course of blocks including mortar head joints and bed joints as the course is assembled.
Figure 45:
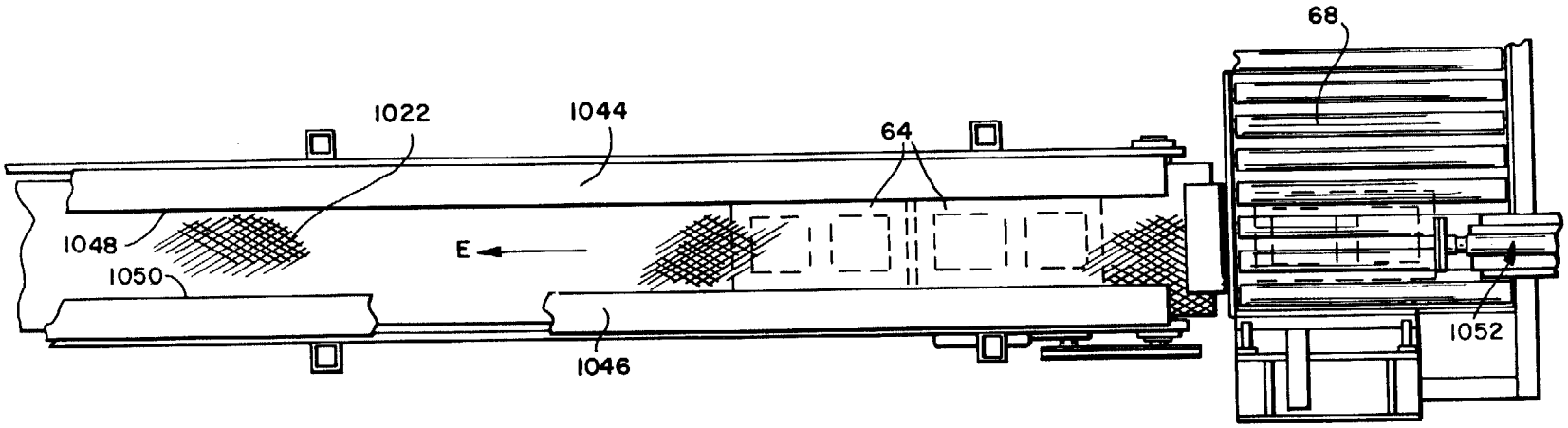
FIG. 45 is a plan view along line 45—45 of FIG. 44.

In the modification as shown in FIGS. 44 and 45, a receiving area 68 is provided which is similar to the structures hereinbefore described and the head joint and bed joint forming mechanisms 72 and 74 and the striker mechanism 75 are similar to those previously described. In this embodiment, a modified frame 1018, as shown in FIG. 44, supports a conveyer table 1020 over which an endless belt 1022 is movably mounted and engaged on rollers 1024 and 1026, the roller 1026 being driven by a chain drive 1028 motivated by a sprocket 1030 driven by a gear motor 1032. Said gear motor 1032 is preferably a DC motor adapted for accelerative and decelerative control and is also provided with a brake for precisely controlling the stopping position of the belt 1022 on the conveyer table 1020.

A cart 1034 similar to the cart described in FIG. 37 and designated 918 is provided with a downwardly extending arm 1036 adapted to engage a roller contact arm 1038 of any one of a plurality of switches 1040. The roller contact arms 1038 are spaced apart on the frame 1018 a distance equal to the modular distance of a full block and a half block. The line of contact arms 1038, spaced as above indicated, extends the entire length of the frame 1018. The cart 1034 operates in substantially the same manner as that hereinbefore described in connection with FIG. 37 of the drawings and is provided with a counter-weight means tending to hold an end 1042 of the cart against the forwardmost block in the course being formed on the belt 1022. It will be understood that the operation of the cart 918 and of the cart 1032 is such that the overall length of a course of concrete blocks or a partial course on the makeup table of the machine is measured precisely each time a block is added so that the overall length can be within the tolerance at which the modular switching positions may be actuated in accordance with either the upstanding post 954 or the roller contact arms 1038. In this manner the head joint mortar may automatically compensate for any discrepancies in the length of the course of blocks or the length of each concrete block or the various blocks each time a block is added so that, as for example, the overall length of a course of the blocks on the makeup conveyer may be maintained within a sixteenth of an inch or so.

Figure 47:
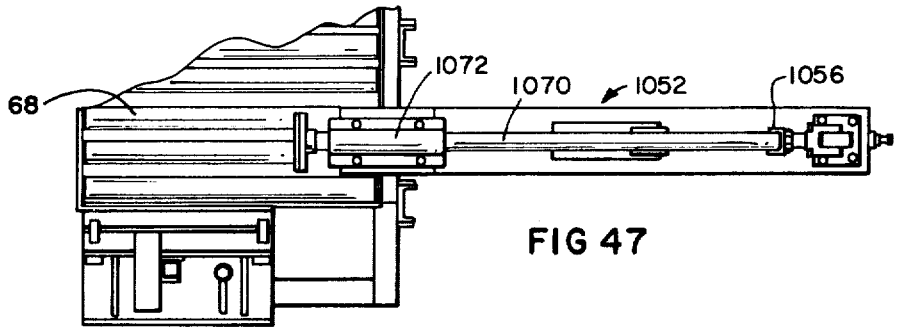
FIG. 47 is a plan view of a modified block pusher mechanism.

The belt 1022 operating on the conveyer table 1020 carries the concrete blocks precisely guided between edges of straight edge members. The straight edge members are designated 1044 and 1046 in FIG. 45 of the drawings and have opposed edges 1048 and 1050 respectively between which opposite sides of the blocks are precisely guided as the belt 1022 carries the course in the direction of an arrow E in FIG. 45 of the drawings. A modified pusher mechanism designated 1052 is provided which is shown in detail in FIGS. 47, 48 and 49.

The pusher mechanism 1052 is provided with a pair of hydraulic cylinders 1054 and 1056 connected in end-to-end series relationship to each other. The hydraulic cylinder 1056 is provided with a plunger 1058 pivotally connected by a pin 1060 to a frame structure 1062 which is stationarily mounted on a modified frame structure 1064 equivalent to the main frame 60 hereinbefore described. Coupled to the hydraulic cylinder 1056 is the hydraulic cylinder 1054 and this hydraulic cylinder 1054 is provided with a plunger 1066 extending in the opposite direction from the plunger 1058 of the hydraulic cylinder 1056. This plunger 1066 operates a pusher plate 1068 carried by a guide bar 1070 slidably mounted in a stationary bearing 1072 carried by the frame structure 1062.

Figure 48:
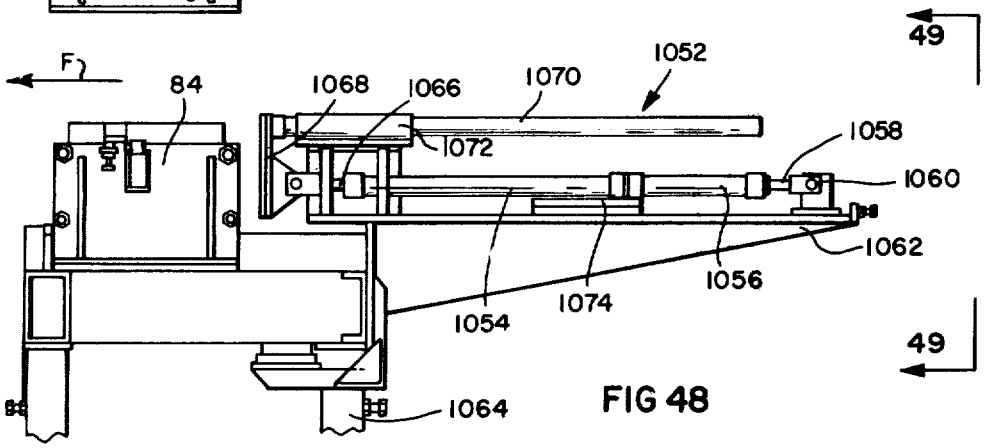
FIG. 48 is a side elevation of the mechanism shown in FIG. 47.
Figure 49:
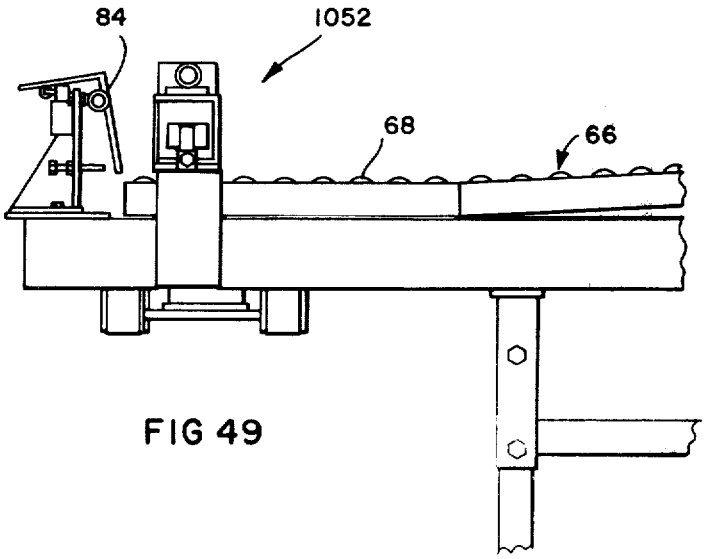
FIG. 49 is an end view of the mechanism shown in FIG. 47 along line 49—49 of FIG. 48.

The hydraulic cylinders 1054 and 1056 are mounted on a slide carriage 1074 carried by the frame structure 1062 so that actuation of the plunger 1058 of cylinder 1056 will extend the pusher plate 1068 in the direction of an arrow F in FIG. 48 of the drawings a distance equal to a half-block while the individual extension of the plunger 1066 from the cylinder 1054 will extend the pusher plate 1068 a distance equal to the modular length of a full length block.

In operation of the modification or species of the invention as shown in FIGS. 44 and 45, the stroke of the pusher mechanism 1052 is fixed and therefore the pusher plate 1068 thereof is pushed out to a fixed position each time a block is pushed from the receiving area 68 onto the makeup table of the invention. The end 1042 of the cart 1034 is precisely located by means of the switches 1040 and the engaging member 1036 of the carts 1034. Accordingly, the overall length of a course of blocks being formed on the makeup table 1020 is precisely established each time a block is added by the pusher 1052 and the overall length of the course or partial course is precisely established between the end 1042 of the cart and the pusher plate 1068 of the pusher mechanism 1052 which is precisely stopped in connection with the pusher cylinders. The presence of a half-block is sensed by a photocell, not shown, which causes the conveyor belt 1022 to advance a half-block or a full block length and which causes the cylinders to advance the block in the receiving area a block length, a half-block length or a modular block length plus a half-block length as required. Accordingly, any mortar joint which may be made by the head joint filler station 72 will vary in thickness according to the requirements automatically established and therefore compensation is made in the thickness of the mortar head joint each time a block is added.

It will be obvious to those skilled in the art that various modifications may be resorted to without departing from the spirit of the invention which is defined in the appended claims.

What is claimed is:

1. In a wall panel manufacturing machine the combination of: a frame, an elongated makeup table adapted to support an elongated course of blocks including a plurality of concrete blocks in end-to-end relation with each other on said table; first means for progressively conveying blocks on to one end of said makeup table; second means for progressively inserting mortar between the adjacent ends of said blocks for forming head joints therebetween; third means for placing mortar on the upper surfaces of said blocks to form bed joints thereon; fourth means for progressively advancing a plurality of said blocks with said head joints and bed joint mortar in a direction longitudinally along said makeup table until an entire course of blocks has been assembled and mortared together thereon; and fifth means for transferring said last-mentioned course of mortared blocks on to an upper surface of previously assembled course or the like.

2. The invention as defined in claim 1 wherein said fourth means comprises sixth means for reciprocating said makeup table toward and away from said first means; and seventh means for clamping opposite sides of a partial course of said blocks in stationary sufficiently when said makeup table is moved toward said first means whereby said entire partial course may be moved away from said first means on said makeup table and then may be held in stationary position by said seventh means while said makeup table is slidably moved under said partial course in a direction toward said first means for progressively receiving the next block thereon from said first means.

3. The invention as defined in claim 1 wherein said fourth means comprises a hydraulic cylinder adapted progressively to slide a partial course of blocks comprising a plurality of blocks with said mortar, longitudinally on said makeup table each time a block is added to the end of said partial course by said first means.

4. The invention as defined in claim 1 wherein said fourth means comprises clamp means adapted to engage and clamp opposite sides of a partial course of blocks; and eighth means said clamp means with said partial course a distance equal to the modulus of one of said blocks and longitudinally relative to said makeup table each time a block is added to said partial course by said first means.

5. The invention as defined in claim 1 wherein said fourth means comprises an endless belt disposed to carry a course of blocks over said makeup table in a direction away from said first means; and means for moving and stopping said belt in said direction and in precise distance increments equal to a modular length of a block and a respective mortar head joint.

6. The invention as defined in claim 1 wherein a modular switching means is disposed adjacent said makeup table; said switching means provided with a plurality of spaced means, said spaced means spaced apart longitudinally along said makeup table in modular increments equalling the modular length of a concrete block and a respective mortar head joint, each of said spaced means disposed to respond to the position of a first block of said plurality, which first block is farthest from said first means each time a new block is added by said first means and advanced by said fourth means, whereby the overall length of said plurality of blocks including head joints therebetween, is measured each time a block is added to said course during the formation thereof; said fourth means having power-operated drive means; said switching means coupled to said drive means for precisely stopping said fourth means corresponding to modular positions of said spaced means.

7. The invention as defined in claim 6 wherein spaced means comprises spaced-apart, mechanically-actuated switches, said switches being spaced apart a distance equal to the modular length of a block and its respective head joint; and a means disposed to move with said first block to successively actuate said mechanically-operable switches.

8. The invention as defined in claim 2 wherein said first means comprises a receiving area; a stationary support near said one end of said makeup table; said stationary support being disposed on a substantially common level with said makeup table; a conveyer for delivering concrete blocks on to said receiving area in a direction laterally with respect to the longitudinal axis of said makeup table; a first switch and switch actuating means disposed at said receiving area and adapted to be engaged by concrete blocks entering said receiving area from said conveyer; block drive means of said conveyer at said makeup area controlled by said first switch and switch actuating means for moving concrete blocks into alignment with said stationary support and said makeup table; a block-pusher means adjacent said receiving area, said block-pusher means disposed to push a first block toward said makeup table until it abuts a second block previously pushed thereon and to a position on said stationary support; pressure sensitive switching means carried by said pusher and disposed to stop movement of said pusher in a direction toward said makeup table when said first block abuts said second block.

9. The invention as defined in claim 8 wherein a drawbar means is coupled to said makeup table, spring loaded block engaging dog means is pivotally connected to said drawbar and disposed in extending position upwardly above said stationary means and adapted to engage an end of a first concrete block facing said pusher; said fourth means adapted for moving said makeup table in a longitudinal direction away from said pusher whereby said second block is moved away from said first block a small distance before said dog means engages said first block which is resting on said stationary support whereupon said makeup table and said first and second blocks move in spaced relation to each other to a position of said second means at which head joint mortar may be dispensed and compacted between said first and second block.

10. The invention as defined in claim 1 wherein a pallet carriage means is disposed to move laterally relative to said makeup table and on a plane therebelow; said pallet carriage means having a plurality of pallet carriages, each carriage having an elongated pallet thereon; said pallets being longitudinally parallel with said makeup table and disposed progressively to be indexed in a position laterally relative to said makeup table for receiving superimposed courses of mortared blocks from said fifth means.

11. The invention as defined in claim 10 wherein said fifth means comprises a course tranfer means; a vertical frame means; course carriage means movable upwardly and downwardly in a vertical direction on said vertical frame means; an elongated course grasping and transfer means horizontally movably mounted on said course carriage means and adapted to move horizontally in a direction transversely relative to said makeup table; said course grasping and transfer means having further means adapted to grasp opposite sides of an entire mortaredtogether course of blocks and to raise said course from said makeup table when said course carriage means moves upwardly on said vertical frame means, whereby said fifth means is adapted to transfer a course of blocks with head joint and bed joint mortar from said makeup table on to one of said pallets or on to a course of blocks previously placed on one of said pallets.

12. The invention as defined in claim 11 wherein said vertical frame means is provided with a plurality of spaced stop members; said stop members each having a generally upwardly inclined portion and a horizontal ledge portion; each horizontal ledge portion being spaced vertically from the next adjacent horizontal ledge portion a distance equal to the modulus of the height of a course of blocks with bed mortar thereon; and means on said course carriage means movable into and out of engagement with said ledge portions to support said fifth means at various elevations for successively placing courses of blocks on a pallet and on courses previously deposited thereon.

13. The invention as defined on claim 11 wherein said vertical frame means comprises a pair of vertical frame members; said course carriage means comprising a pair of carriages on said pair of vertical frame members; and a torque bar having gears on opposite ends thereof; a gear rack on said carriage in mesh with said gears on said torque bar; said torque bar rotatably mounted on said course grasping and transfer means.

14. The invention as defined in claim 11 wherein power operated means is provided for moving said course carriages up and down on said vertical frame means, said power operated means comprising rotary means supported by said vertical frame means at upper and lower positions thereon and flexible means engaging said rotary means and having opposite ends thereof coupled to said carriage means; and motorized means for driving said rotary means.

15. The invention as defined in claim 10 wherein a pair of spaced-apart parallel tracks extend laterally below said makeup table; said pallet carriage means having rollers movable on said tracks; a pair of hydraulic cylinders adjacent said tracks and having extendable plungers; a pawl member operable by each of said hydraulic cylinders; both of said power means engageable concurrently with one of said pallet carriages; a bar coupled in cantilever relation to one of said power means; said bar having an extending end extending into proximity with the other of said power means; a pair of opposed deflectable control members adapted to be engaged by opposite sides of said extending end of said bar in a direction parallel to said tracks; said deflectable control members adapted to control relative extension or retraction of said plungers of said hydraulic cylinders whereby said pawl members are operated to maintain a respectively engaged pallet carriage substantially parallel with said makeup table when a pallet is moved laterally relative thereto.

16. The invention as defined in claim 1 wherein said second means comprises a hopper disposed above said makeup table and having an outlet disposed to be operated above as space between adjacent vertical surfaces of blocks on said makeup table, said hopper having an assembly of fingers movably extendable through said outlet and downwardly into said space between said blocks; vibratory means for inducing mortar to flow from said outlet of said hopper and into said space; and means for retracting said fingers upwardly and out of interference with said blocks when said space is filled with mortar thereby forming a head joint between adjacent vertical surface of said blocks.

17. The invention as defined in claim 16 wherein said third means is disposed adjacent to said second means and having a bed box movable upwardly and downwardly relative to upper surfaces of blocks on said makeup table, said bed box having a downwardly directed outlet movable into close proximity with said upper surfaces of said blocks, said outlet having the shape of the upper surface edges of said blocks; and substantially horizontal sliding plate-like gates movable into and out of said outlet of said bed box for shutting off flow of bed joint mortar from said outlet; said gates spaced above the lower extremities of said outlet a distance substantially equal to the elevation of a mortar bed joint to be placed on said upper surface edges of said blocks; said gates having means for moving them horizontally and having opposed edges disposed to be forced together at a median area of said bed box outlet to shut off flow of mortar from said bed box outlet.

18. The invention as defined in claim 17 wherein means are provided for moving said gates to shut off the flow of mortar concurrently with the raising or upward movement of said outlet of said bed box away from said upper surface of said blocks.

19. The invention as defined in claim 16 wherein said assembly of fingers also includes a pair of mortar retaining fingers aligned with said space and spaced apart for disposal close to opposite vertical sides of said blocks whereby the tendency of mortar to exude laterally from said space at said opposite vertical sides of said blocks during the deposit and compaction of mortar into said space and during upward retraction of said finger assembly to a position above said blocks and said space is minimized.

20. The invention as defined in claim 16 wherein head joint mortar strike means is provided with a pair of spaced-apart, elongated, substantially vertical strike fingers; said fingers being spaced apart a distance less than the horizontal width of concrete blocks and adapted to strike vertical mortar joints therebetween; and means movably mounting said strike fingers to move up and down on said carriage to strike vertical mortar joints between said blocks near the outer opposite sides thereof.

21. The invention as defined in claim 20 wherein said strike fingers are resiliently mounted so as to deflect laterally of their axes.

22. The invention as defined in claim 20 wherein said strike fingers are supported in a finger carriage, means for mounting said finger carriage for movement longitudinally with reference to said makeup table, and switch means to move said finger carriage to index said strike fingers relative to head joint mortar on full blocks and half blocks.

23. The invention as defined in claim 3 wherein spacer mechanism is adapted to grasp a first one of said blocks and move it away from an adjacent block longitudinally relative to said makeup table a distance of the mortar head joint to be made so that a head joint may be formed between adjacent vertical surfaces of said first block and said adjacent block.

24. The invention as defined in claim 20 wherein said strike fingers are provided with rollers thereon adapted to roll mortar and thereby strike the same at said head joints.

25. The invention as defined in claim 1 wherein said first means comprises pusher means for pushing blocks longitudinally on to said makeup table; said pusher means comprising a pair of fluid-actuated cylinders being coupled in end-to-end series relationship, one of said cylinders having a stroke equal to the overall length of a concrete block and the other of said cylinders having a stroke equal to the length of a half block and both cylinders operably individually or collectively in order to stroke said pusher mechanism and a block pushed thereby the full length of a concrete block or the combined length of a concrete block and a half block.

26. In a wall panel manufacturing apparatus the combination of: an elongated makeup section adapted to support an elongated course of blocks including a plurality of blocks in aligned relation with each other; means progressively conveying unmortared blocks to and along said makeup section; means for successively inserting mortar between the adjacent ends of said blocks on said makeup section for forming head joints therebetween; means for placing mortar on the upper surfaces of said blocks on said makeup section to form bed joints thereon; means for progressively advancing a plurality of said blocks in alignment together with said head joints and bed joint mortar, in a direction longitudinally along said makeup section until a plurality of blocks are assembled and mortared together; and means for transferring said last-mentioned course of mortared blocks as a unit to a panel assembly station where said course is assembled with other courses to form a wall panel.

27. The apparatus of claim 26 which includes means for conveying the mortared blocks along the makeup section in increments related to the nominal dimension of a block and in which means are provided to place on additional unmortared block on said makeup section incident to the advancement of blocks on said makeup section.

* * * * *